US006238834B1

(12) United States Patent
Tamura et al.

(10) Patent No.: US 6,238,834 B1
(45) Date of Patent: May 29, 2001

(54) MAGNETIC TONER FOR DEVELOPING ELECTROSTATIC IMAGES, PROCESS FOR PRODUCING IT, IMAGE FORMING METHOD AND PROCESS CARTRIDGE

(75) Inventors: Osamu Tamura, Kashiwa; Koichi Tomiyama, Numazu; Shunji Suzuki, Tokyo; Yoshihiro Ogawa, Numazu, all of (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 09/084,993

(22) Filed: May 28, 1998

(30) Foreign Application Priority Data

May 30, 1997 (JP) ..... 9-140768
May 30, 1997 (JP) ..... 9-140771
Nov. 7, 1997 (JP) ..... 9-305146

(51) Int. Cl.[7] ..... G03G 9/083

(52) U.S. Cl. ..... 430/106.6; 430/137; 430/110; 399/111

(58) Field of Search ..... 430/106.6, 137, 430/110; 399/111

(56) References Cited

U.S. PATENT DOCUMENTS

| | | | | |
|---|---|---|---|---|
| 5,215,845 | | 6/1993 | Yusa et al. | 430/106.6 |
| 5,262,267 | | 11/1993 | Takiguchi et al. | 430/122 |
| 5,364,720 | | 11/1994 | Nakazawa et al. | 430/106.6 |
| 5,424,810 | | 6/1995 | Tomiyama et al. | 355/251 |
| 5,641,600 | * | 6/1997 | Kotaki et al. | 430/106.6 |
| 5,672,454 | * | 9/1997 | Sasaki et al. | 430/106.6 |
| 5,712,070 | | 1/1998 | Nozawa et al. | 430/106.6 |
| 5,736,288 | | 4/1998 | Kasuya et al. | 430/106.6 |
| 5,750,302 | | 5/1998 | Ogawa et al. | 430/106.6 |
| 5,780,190 | * | 7/1998 | Listigovers et al. | 430/106.6 |

FOREIGN PATENT DOCUMENTS

| | | |
|---|---|---|
| 0749049 | 12/1995 | (EP) . |
| 0729075 | 8/1996 | (EP) . |
| 0822457 | 2/1998 | (EP) . |
| 8-123083 | 5/1996 | (JP) . |

* cited by examiner

*Primary Examiner*—Christopher Rodee
(74) *Attorney, Agent, or Firm*—Fitzpatrick, Cella, Harper & Scinto

(57) ABSTRACT

A magnetic toner for developing an electrostatic image is comprised of magnetic toner particles containing at least a binder resin, a magnetic fine powder and a wax. The magnetic toner particles have a weight-average particle diameter of from 3.5 to 6.5 $\mu$m, and a dispersion prepared by dispersing 15 mg of the magnetic toner particles in 19 ml of an aqueous solution of ethyl alcohol and water in a volume ratio of 27:73 has an absorbance of from 0.2 to 0.7 at a wavelength of 600 nm.

A process for producig such a magnetic toner is charcterized by, especially, the melt-kneading step carried out under the following conditions:

$$2.2\times10^3 \leqq E/\epsilon \leqq 2.0\times10^4$$

$$E=k\omega^2T,\ \epsilon=F/(\pi D^2L)$$

wherein $\omega$ represents a screw rotational speed (m/min), T represents a preset temperature (K), F represents a feed rate (kg/min) of a mixture of a binder resin, a magnetic fine powder and a wax, D represents a cylinder inner diameter (m), L represents a screw effective length (m), $\pi$ represents the circular constant, and k represents $(D_0/D)^2$, where $D_0$ is 0.1 m.

44 Claims, 9 Drawing Sheets

MAGNETIC TONER FOR DEVELOPING ELECTROSTATIC IMAGES, PROCESS FOR PRODUCING IT, IMAGE FORMING METHOD AND PROCESS CARTRIDGE

BACKGROUND OF THE INVENTION

1. Field of the Invention

This invention relates to a magnetic toner for developing electrostatic images to form toner images in image forming processes such as electrophotography. It also relates to a process for producing the magnetic toner, an image forming method useing the magnetic toner and a process cartridge having the magnetic toner.

2. Related Background Art

In recent years, image forming apparatus employing electrophotographic techniques, such as copying machines and laser beam printers, have come to function in a variety of ways and are sought to make images have much higher minuteness and higher image quality.

Accordingly, there is a tendency to employ magnetic toner particles having finer particle diameters than ever. When the magnetic toner particles are made to have smaller particle diameters, images can be made to have higher minuteness. On the other hand, the phenomenon of fog caused by adhesion of magnetic toner to non-image areas tends to occur especially in an environment of low temperature and low humidity. In an environment of high temperature and high humidity, images tend to be formed in a low density when copies or prints are taken firstly in the morning. Moreover, nowadays, taking account of environmental problems, it has come to employ a method of charging photosensitive members by means of contact charging members without using ozone-causative corona charging assemblies.

In this instance, however, fine particles of magnetic toner particles that are not sufficiently removed by cleaning with a cleaning member may adhere to the contact charging member (hereinafter "charging-roller contamination") in the environment of low temperature and low humidity to cause faulty charging, which may further cause faulty images. In the environment of high temperature and high humidity, the above fine particles tend to adhere to the surface of the photosensitive drum which is an electrostatic latent image bearing member, when they are pressed against it by the contact charging member (this phenomenon is herein called "melt-adhesion to drum").

It has been ascertained that such fine particles are comprised chiefly of silica fine powder and/or magnetic fine power, the former being used as a fluidity improver and the latter being a material constituting the magnetic toner particles. Moreover, in the case of the magnetic toner having much finer particle diameter than ever as stated above, the magnetic fine powder tends to more adhere to the contact charging member and photosensitive drum.

A method is conventionally known in which the particle surfaces of the magnetic fine powder are previously treated with an organic matter in order to improve the close contact of binder resin to magnetic fine powder. This, however, tends to cause faulty coating (a blotch phenomenon) when a magnetic toner layer is applied onto a toner carrying member in the environment of low temperature and low humidity. The surface treatment of the magnetic fine powder may also result in a higher production cost.

As means for solving the above problems, it is long-awaited to propose a novel toner in which the state of presence of magnetic fine powder on the surfaces of magnetic toner particles has been controlled, and to propose a novel process for producing such a toner.

It is difficult to uniformly disperse all materials such as binder resin, magnetic fine powder and wax in a kneaded product. For example, the kneading conditions taking account of the wettability of magnetic fine powder by binder resin and the kneading conditions taking account of the dispersibility of binder resin in wax are incompatible with each other.

In Japanese Patent Application Laid-Open No. 8-123083, a toner production process is proposed which specifies temperature conditions required when the materials are melt-kneaded by means of a screw extruder having a feed screw zone and a kneading zone. Examples set out in this publication disclose a process for producing a magnetic toner having a volume-average particle diameter (d50) of from 7.15 to 7.23 μm. Even in this production process, as the magnetic toner comes to have a smaller average particle diameter, the magnetic fine particles tend to become liberated from the magnetic toner particle surfaces to highly tend to result in an increase in the number of free magnetic fine particles. Also, in this production process, the temperature in the extruder is set lower on the outlet side of the kneaded product, which is required for compulsorily cooling the kneaded product heated in the extruder. It is commonly difficult to control such temperature, which requires so great a load that the process is hard to control in actual production.

SUMMARY OF THE INVENTION

An object of the present invention is to provide a magnetic toner that may cause less fog and may hardly cause faulty charging, in an environment of low temperature and low humidity, and a process for producing such a toner.

Another object of the present invention is to provide a magnetic toner that can form images with a high image density and has been restrained from causing the "melt-adhesion to drum" onto the photosensitive drum surface, in an environment of high temperature and high humidity, and a process for producing such a toner.

Still another object of the present invention is to provide a magnetic toner that has a small weight-average particle diameter and may less cause the liberation of magnetic fine particles from magnetic toner particles, and a process for producing such a toner.

A further object of the present invention is to provide an image forming method using such a magnetic toner.

A still further object of the present invention is to provide a process cartridge having such a magnetic toner.

To achieve the above objects, the present invention provides a magnetic toner for developing an electrostatic image, comprising magnetic toner particles containing at least a binder resin, a magnetic fine powder and a wax, wherein;

the magnetic toner particles have a weight-average particle diameter of from 3.5 to 6.5 μm; and a dispersion prepared by dispersing 15 mg of the magnetic toner particles in 19 ml of a mixed solution of ethyl alcohol and water in a volume ratio of 27:73 has an absorbance of from 0.2 to 0.7 at a wavelength of 600 nm.

The present invention also provides a process for producing a magnetic toner having magnetic toner properties, comprising the step of melt-kneading a mixture having at least a binder resin, a magnetic fine powder and a wax, by means of a kneading machine to obtain a kneaded product; cooling the kneaded product to obtain a cooled product;

pulverizing the cooled product to obtain a pulverized product; and classifying the pulverized product to obtain magnetic toner particles; wherein;

the mixture is melt-kneaded under conditions of:

$$2.2\times10^3 \leqq E/\epsilon \leqq 2.0\times10^4$$

$$E=k\omega^2T,\ \epsilon=F/(\pi D^2L)$$

wherein ω represents a screw rotational speed (m/min), T represents a preset temperature (K), F represents a feed rate (kg/min) of the mixture, D represents a cylinder inner diameter (m), L represents a screw effective length (m), π represents the circular constant, and k represents $(D_0/D)^2$, where $D_0$ is 0.1 m;

the magnetic toner particles have a weight-average particle diameter of from 3.5 to 6.5 μm; and a dispersion prepared by dispersing 15 mg of the magnetic toner particles in 19 ml of a mixed solution of ethyl alcohol and water in a volume ratio of 27:73 has an absorbance of from 0.2 to 0.7 at a wavelength of 600 nm.

The present invention still also provides an image forming method comprising electrostatically charging an electrostatic image bearing member by a contact charging means to which a bias is applied; subjecting the electrostatic image bearing member thus charged, to exposure to form an electrostatic image; and developing the electrostatic image by a developing means having a magnetic toner to form a magnetic toner image;

the magnetic toner comprising magnetic toner particles containing at least a binder resin, a magnetic fine powder and a wax; wherein;

the magnetic toner particles have a weight-average particle diameter of from 3.5 to 6.5 μm; and a dispersion prepared by dispersing 15 mg of the magnetic toner particles in 19 ml of a mixed solution of ethyl alcohol and water in a volume ratio of 27:73 has an absorbance of from 0.2 to 0.7 at a wavelength of 600 nm.

The present invention further provides a process cartridge comprising an electrostatic image bearing member, a contact charging means for electrostatically charging the electrostatic image bearing member, and a developing means holding a magnetic toner;

the magnetic toner comprising magnetic toner particles containing at least a binder resin, a magnetic fine powder and a wax; wherein;

the magnetic toner particles have a weight-average particle diameter of from 3.5 to 6.5 μm; and a dispersion prepared by dispersing 15 mg of the magnetic toner particles in 19 ml of a mixed solution of ethyl alcohol and water in a volume ratio of 27:73 has an absorbance of from 0.2 to 0.7 at a wavelength of 600 nm.

DESCRIPTION OF THE PREFERRED EMBODIMENTS

Figure 1:
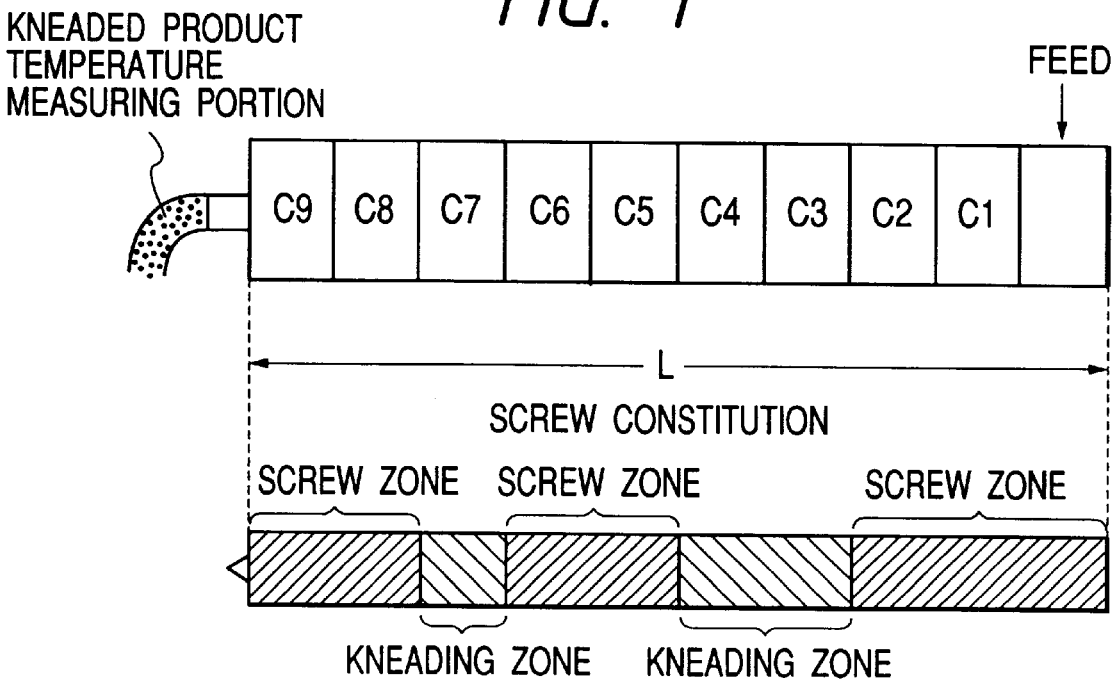
FIG. 1 is a schematic illustration of the constitution of a temperature control unit and a screw of a kneader.

With regard to the contamination of the charging member which is a kind of contact charging means and the toner melt-adhesion to drum onto the surface of the photosensitive drum which is a kind of electrostatic image bearing member, some magnetic toners tend to cause these problems and some may hardly cause similar problems. Studies were made on how to simply find the difference between magnetic toner particles constituting the former toners and magnetic toner particles constituting the latter toners, without relying on the evaluation by image reproduction. As a result, it has been found that such difference can be detected by a method using a dispersion prepared by dispersing magnetic toner particles in a mixed solution of ethyl alcohol and water.

The fact that the dispersion has a high absorbance indicates that the magnetic toner particles stand readily wettable by the aqueous solution and that magnetic fine powder is present in a large quantity on the surfaces of the magnetic toner particles. Such magnetic toner particles tend to liberate magnetic fine particles from their surfaces. In fact, when magnetic toners produced from such magnetic toner particles are evaluated by image reproduction, such problems as charging roller contamination and melt-adhesion to photosensitive drum surface tend to occur. It has been ascertained that many magnetic fine particles are present in the contaminants on the charging roller surface and in the molten deposits on the photosensitive drum surface. This can be said to be a measuring method by which the quantity of magnetic fine powder present on the surfaces of the magnetic toner particles can be clearly and properly shown.

The magnetic toner particles used in the present invention have a weight-average particle diameter of from 3.5 to 6.5 μm, and a dispersion prepared by dispersing 15 mg of the magnetic toner particles in 19 ml of a mixed solution of ethyl alcohol and water (volume ratio: 27:73) has an absorbance of from 0.2 to 0.7 at a wavelength of 600 nm.

The weight-average particle diameter of the magnetic toner or magnetic toner particles is measured by a Coulter counter method.

As a device for measuring the average particle diameter of the magnetic toner particles and magnetic toner by the Coulter counter method, a Coulter counter Model TA-II or Coulter Multisizer (manufactured by Coulter Electronics, Inc.) is used. As an electrolytic solution, an aqueous 1% NaCl solution is prepared using first-grade sodium chloride. For example, ISOTON R-II (trade name, manufactured by Coulter Scientific Japan Co.) may be used. Measurement is carried out by adding as a dispersant 0.1 to 5 ml of a surface active agent, preferably an alkylbenzene sulfonate, to 100 to 150 ml of the above aqueous electrolytic solution, and further adding 2 to 20 mg of a sample to be measured. The electrolytic solution in which the sample has been suspended is subjected to dispersion for about 1 minute to about 3 minutes in an ultrasonic dispersion machine. The volume distribution and number distribution of the magnetic toner particles or magnetic toner are calculated by measuring the volume and number of toner particles by means of the above measuring device, using an aperture of 100 μm as its aperture. Then the weight-based, weight average particle diameter (D4) determined from the volume distribution of magnetic toner particles or magnetic toner are determined.

As channels, 13 channels are used, which are of 2.00 to less than 2.52 μm, 2.52 to less than 3.17 μm, 3.17 to less than 4.00 μm, 4.00 to less than 5.04 μm, 5.04 to less than 6.35 μm, 6.35 to less than 8.00 μm, 8.00 to less than 10.08 μm, 10.08 to less than 12.70 μm, 12.70 to less than 16.00 μm, 16.00 to less than 20.20 μm, 20.20 to less than 25.40 μm, 25.40 to less than 32.00 μm, and 32.00 to less than 40.30 μm. Particles with particle diameters of 2.00 or larger to smaller than 40.30 μm are used for the measurement.

In the above measurement, even when an external additive is externally added to the magnetic toner particles, the weight-average particle diameter of magnetic toner is usually shown as substantially the same value as the weight-average particle diameter of magnetic toner particles.

The absorbance of the magnetic toner particles is measured in the following way.

i) Preparation of Dispersion:

A mixed solution of ethyl alcohol (special grade 99.5%, available from Kishida Chemical Co., Ltd.) and water in a mixing ratio of 27:73 is prepared. 19 ml of this mixed solution is put into a 20 ml sample bottle (trade name: LABORAN PACK; available from Iuchi), 15 mg of magnetic toner particles are put on the liquid surface so as to lie soaking, and the bottle is stoppered. In this state, it is allowed to stand for 20 minutes. With the passage of time, readily wettable particles begin to fall and disperse in the solution. After 20 minutes have passed, the sample bottle is picked up with fingers, and the sample bottle is shaked by turning it upside down for 180 degrees, making the dispersion uniform so as to be used as a dispersion for measurement.

ii) Measurement of Absorbance:

The dispersion obtained in the step i) is put into a quartz cell of 1 cm square in size, and the absorbance of the dispersion at a wavelength of 600 nm is measured with a spectrophotometer MPS2000 (manufactured by Shimadzu Corporation).

If the absorbance is greater than 0.7, the magnetic fine particles may be present on the surfaces of the magnetic toner particles in large numbers and free magnetic fine particles are liable to come into being, so that the charging roller contamination and the melt-adhesion to drum tend to occur. If the absorbance is smaller than 0.2, the magnetic fine particles may be excessively restrained from standing bare on the surfaces of the magnetic toner particles, tending to cause the problem of, e.g., image density decrease caused by charge-up of the magnetic toner particles in an environment of low temperature and low humidity. Thus, the absorbance may be from 0.2 to 0.7, preferably from 0.30 to 0.69, and more preferably from 0.35 to 0.65.

The magnetic toner particles have a weight-average particle diameter (D4) of from 3.5 to 6.5 μm. If they have a weight-average particle diameter larger than 6.5 μm, it is difficult to achieve a high image quality, and if smaller than 3.5 μm, fog tends to occur and an image density decrease and a low productivity tends to result.

The magnetic fine powder may preferably be contained in the magnetic toner particles in an amount of from 40 to 60% by weight. The magnetic toner comprised of magnetic toner particles having a smaller weight-average particle diameter than ever may make it difficult to prevent fog from occurring if the magnetic fine powder is in an amount less than 40 in the magnetic toner particles. If in an amount more than 60% by weight, the image density tends to decrease or the free magnetic fine particles tend to occur, and an increase in the free magnetic fine particles tends to cause the charging roller contamination and melt-adhesion to drum.

The magnetic toner particles may preferably have the value of shape factor SF-1 of $140<SF\text{-}1\leqq 180$ and the value of shape factor SF-2 of $130<SF\text{-}2\leqq 170$.

If the magnetic toner particles have a shape factor SF-1 or SF-2 of less than 140 or 130, respectively, the magnetic toner particle surfaces stand smooth to tend to cause the phenomenon of charge-up when the magnetic toner particles are made into finer particles than ever, tending to cause the image density decrease or the blotch phenomenon in an environment of low temperature and low humidity. If the magnetic toner particles have a shape factor SF-1 of more than 180, the magnetic toner tends to have a low fluidity to tend to cause a decrease in image density. If the magnetic toner particles have a shape factor SF-2 of more than 170, it may be difficult to attain uniform charging and there is a tendency to cause fog.

In the present invention, the shape factors SF-1 and SF-2 are the values obtained by sampling at random 100 toner particle images of magnetic toner particles with particle diameters of 2 μm or larger by the use of, e.g., FE-SEM (S-800; a scanning electron microscope manufactured by Hitachi Ltd.), introducing their image information into an image analyzer (LUZEX-III; manufactured by Nikore Co.) through an interface to make analysis, and calculating the data according to the following expression. The values obtained are defined as shape factors SF-1 and SF-2.

$$SF\text{-}1=(MXLNG)^2/AREA\times\pi/4\times 100$$

$$SF\text{-}2=(PERIME)^2/AREA\times 1/4\pi\times 100$$

wherein MXLNG represents an absolute maximum length of a toner particle, PERIME represents a peripheral length of a toner particle, and AREA represents a projected area of a toner particle.

The shape factor SF-1 indicates the degree of sphericity of toner particles. The shape factor SF-2 indicates the degree of surface irregularity of toner particles.

The magnetic toner particles may more preferably have a ratio of shape factor SF-1 to shape factor SF-2 (SF-1/SF-2) of from 1.01 to 1.20. Still more preferably, the magnetic toner particles may have a shape factor SF-1 of from 145 to 160, a shape factor SF-2 of from 135 to 155, and a ratio of shape factor SF-1 to shape factor SF-2 (SF-1/SF-2) of from 1.05 to 1.15.

In the measurement of the SF-1 and SF-2 of a magnetic toner having magnetic toner particles to which an external additive is externally added, the toner usually shows substantially the same values as the SF-1 and SF-2 of the magnetic toner particles because the external additive has a very small particle diameter or an external additive having a large particle diameter is in a small number of particles.

In the magnetic toner of the present invention, the magnetic fine powder may have, under application of a magnetic field of 795.8 kA/m (10 K oersted), a residual magnetization [$\sigma r$ ($Am^2/kg$)] and a coercive force [Hc (kA/m)] the product of which ($\sigma r\times Hc$) is in the range of from 24 to 56 ($kA^2m/kg$).

As a developing method in which the magnetic toner of the present invention is preferably used, it may include a method in which a magnet is provided inside the toner carrying member so that the magnetic toner is attracted and held thereon by this magnet, and the magnetic toner charged by triboelectric charging on the toner carrying member is used to develop an electrostatic image formed on the electrostatic image bearing member. When the magnetic toner particles having a weight-average particle diameter of from 3.5 to 6.5 μm is used in such a developing method, the fog and the phenomenon of solid black density decrease at the time of repetitive development operation tend to occur in an environment of low temperature and low humidity and the phenomenon of the melt-adhesion to drum tends to occur in an environment of high temperature and high humidity. These problems can be effectively solved by controlling the magnetic force (σr×Hc) of the magnetic fine powder. In the environment of low temperature and low humidity, the magnetic force may be imparted to the magnetic toner so that the development by a magnetic toner having a high quantity of triboelectricity can be restrained, whereby the image density can be maintained and the fog can be more desirably prevented from occurring.

In addition, the magnetic toner is bound to the toner carrying member surface by virtue of an appropriate magnetic binding force, so that the magnetic toner can be improved in its circulation on the toner carrying member surface, and there can be prevented the phenomenon of solid-black density decrease at the time of repetitive development operation which is considered to be caused by excessive charge-up of the magnetic toner in the environment of low temperature and low humidity. Also in the environment of high temperature and high humidity, magnetic toner particles having a high quantity of triboelectricity tends to selectively participate in the development. The smaller the particle diameter is made, the more the phenomenon of the melt-adhesion to drum tends to occur. Even in this instance, such a phenomenon can be prevented by imparting to the magnetic toner the magnetic force that can prevent the development by a magnetic toner having a relatively higher quantity of triboelectricity.

If a magnetic fine powder whose value of σr×Hc is less than 24 is used, the magnetic binding force can not effectively act, so that the fog and the phenomenon of solid-black density decrease at the time of repetetive development operation tend to occur in the environment of low temperature and low humidity and the phenomenon of the melt-adhesion to drum tends to occur in the environment of high temperature and high humidity. If the value of σr×Hc is more than 56, the magnetic binding force may become predominant on the contrary, a decrease in image density tends to occur in any environment, undesirably. The range of from 30 to 52 is more preferable. In the present invention, the above magnetic characteristics are measured using VSMP-1-10 (manufactured by Toei Kogyo K.K.) under an external magnet field of 795.8 kA/m.

The magnetic fine powder used in the magnetic toner of the present invention may include metal oxides having magnetic properties, which contain an element such as iron, cobalt, nickel, copper, magnesium, manganese, aluminum or silicon. Such a magnetic fine powder may preferably have a number-average particle diameter of from 0.05 to 0.30 μm, and more preferably from 0.10 to 0.25 μm. If it has a number-average particle diameter smaller than 0.05 μm, the magnetic fine powder tends to have a reddish tint. This is not preferable because such a tint is reflected on the tint of images in the case of the magnetic toner. One having a number-average particle diameter larger than 0.30 μm is also not preferable because the image density and fog may have a narrow latitude.

The shape of the magnetic fine particles constituting the magnetic fine powder used in the present invention may be octahedral, hexahedral or spherical. The shape of the magnetic fine particles may preferably be spherical because the latitude of the image density and fog can be made broad.

In order to satisfy the subject of the present invention at a higher level, the magnetic fine particles constituting the magnetic fine powder may preferably have at least silicon dioxide on their surfaces. When the % by weight of the silicon dioxide present on the surfaces is represented by W (%) and the number-average particle diameter of the magnetic fine powder is represented by R (μm), the value of W×R may preferably satisfy 0.003 to 0.042. The value of W×R will be described below.

(a) Measurement of W:

(1) Silicon dioxide present on the surfaces of the magnetic fine particles constituting the magnetic fine powder is eluted with a 2N-NaOH solution (40° C., for 30 minutes).

(2) The quantities of $SiO_2$ in the magnetic fine powder before and after elution are measured by fluorescent X-ray analysis.

$$W\ (\%)=[(SiO_2 \text{ quantity before elution})/(SiO_2 \text{ quantity after elution})]\times 100$$

(b) Measurement of R:

Photographs of the magnetic fine particles are taken with a transmission electron microscope at 40,000 magnifications, from which 250 particles are selected at random. Thereafter, the Martin diameter in the projected diameter (the length of a segment of a line that bisects the projected area in a fixed direction) is measured, and the number-average particle diameter is calculated from the measurements.

When the value of W×R is defined, it can be more clearly understood whether the presence of $SiO_2$ on the surfaces of magnetic fine particles is in a dense state or in a sparse state.

The specific surface area determined from the average particle diameter of the magnetic fine powder is represented by S, and the density of the magnetic fine powder by ρ. Thus, $S=4\pi R2\times[1/(4/3)\pi R3\cdot\rho]=3/R\cdot\rho$. The state of the presence of $SiO_2$ on the surfaces is actually given by $W/S=R\cdot W\cdot\rho/3$. A preferable range of the W/S is $0.001\ \rho \leqq W/S \leqq 0.014\ \rho$, and therefore $0.001\ \rho \leqq R\cdot W\cdot\rho/3 \leqq 0.014\ \rho$. This expression can be simplified to be $0.003 \leqq W\times R \leqq 0.042$.

If the value of W×R is smaller than 0.003, the $SiO_2$ is present on the surfaces of magnetic fine particles so sparsely that the fluidity cannot be effectively imparted to the magnetic toner, tending to cause a decrease in image density and an increase in fog in the environment of low temperature and low humidity. If the value of W×R is larger than 0.042, the wettability of the magnetic fine powder by the binder resin at the time of kneading may lower and the magnetic fine particles are liable to come off the magnetic toner particles when the toner is produced, and the free magnetic fine particles thus formed tend to cause the melt-adhesion to drum. The value of W×R is more preferably in the range of from 0.008 to 0.035.

The magnetic fine powder may preferably be contained in the magnetic toner particles in an amount of from 40 to 60% by weight. If it is in an amount less than 40% by weight, it may be difficult to prevent fog from occurring in the case of the magnetic toner particles having a weight-average particle diameter of from 3.5 to 6.5 μm. If it is in an amount more than 60% by weight, the image density decrease, charging roller contamination and melt-adhesion to drum tend to occur. The magnetic fine powder may more preferably be contained in the magnetic toner particles in an amount of from 45 to 55% by weight.

The magnetic toner particles of the magnetic toner of the present invention contains a wax. The wax may include paraffin wax and derivatives thereof, microcrystalline wax and derivatives thereof, Fischer-Tropsch wax and derivatives thereof, polyolefin wax and derivatives thereof, carnauba wax and derivatives thereof, long-chain carboxylic acids and derivatives thereof, and long-chain alcohols and derivatives thereof. The derivatives include oxides, block copolymers of the wax with vinyl monomers, and graft modified products of the wax with vinyl monomers.

Waxes preferably used in the present invention may be waxes represented by the general formula R—Y (wherein R represents a hydrocarbon group, and Y represents a hydroxyl group, a carboxyl group, an alkyl ether group, an ester group or a sulfonyl groups) and having a weight-average molecular weight (Mw) of not more than 3,000 as measured by gel permeation chromatography (GPC).

As specific examples, the following compounds may be named:

(A) $CH_3(CH_2)_nCH_2OH$ (n=20 to 300)

(B) $CH_3(CH_2)_nCH_2COOH$ (n=20 to 300)

(C) $CH_3(CH_2)_nCH_2OCH_2(CH_2)_mCH_3$ (n=20 to 200, m=0 to 100)

The above compounds (B) and (C) are derivatives of the compound (A), and their back bone chains are straight-chain saturated hydrocarbons. Compounds other than those exemplified above may also be used so long as they are compounds derived from the compound (A). Particularly preferred waxes are those chiefly composed of long-chain alkyl alcohols represented by $CH_3(CH_2)_nOH$ (n=20 to 300) and mixtures thereof.

When such a long-chain alkyl alcohol wax is used, the dispersibility of the wax in the binder resin at the time of kneading can be so good that it is unnecessary to set any kneading conditions more severely taking account of the dispersibility of wax than conventional kneading conditions and it becomes possible to set conditions taking account of the wettability of the magnetic fine powder by the binder resin.

In the conventional kneading conditions, the kneading temperature immediately after the ejection of a kneaded product from a kneader is commonly an important parameter to see the state of kneading. Even under kneading conditions where the kneading temperature is 30 to 70° C. higher than the softening point of the long-chain alkyl alcohol wax, the wax can be well dispersed in the binder resin. Also, in such an instance, the magnetic fine powder can be well wetted by the binder resin, and hence the object of the present invention can be achieved more desirably.

The binder resin used in the magnetic toner of the present invention will be described below.

The binder resin used in the present invention may include, e.g., polystyrene; homopolymers of styrene derivatives such as poly-p-chlorostyrene and polyvinyltoluene; styrene copolymers such as a styrene-p-chlorostyrene copolymer, a styrene-vinyltoluene copolymer, a styrene-vinylnaphthalene copolymer, a styrene-acrylate copolymer, a styrene-methacrylate copolymer, a styrene-methyl α-chloromethacrylate copolymer, a styrene-acrylonitrile copolymer, a styrene-methyl vinyl ether copolymer, a styrene-ethyl vinyl ether copolymer, a styrene-methyl vinyl ketone copolymer, a styrene-butadiene copolymer, a styrene-isoprene copolymer and a styrene-acrylonitrile-indene copolymer; polyvinyl chloride, phenol resins, natural resin modified phenol resins, natural resin modified maleic acid resins, acrylic resins, methacrylic resins, polyvinyl acetate, silicone resins, polyester resins, polyurethane resins, polyamide resins, furan resins, epoxy resins, xylene resins, polyvinyl butyral, terpene resins, cumarone indene resins, and petroleum resins. Cross-linked styrene resins are also preferred binder resins.

Comonomers copolymerizable with styrene monomers in the styrene copolymers may include monocarboxylic acids having a double bond and derivatives thereof, such as acrylic acid, methyl acrylate, ethyl acrylate, butyl acrylate, dodecyl acrylate, octyl acrylate, 2-ethylhexyl acrylate, phenyl acrylate, methacrylic acid, methyl methacrylate, ethyl methacrylate, butyl methacrylate, octyl methacrylate, acrylonitrile, methacrylonitrile and acrylamide; dicarboxylic acids having a double bond and derivatives thereof such as aleic acid, butyl maleate, methyl maleate and dimethyl maleate; vinyl esters such as vinyl chloride, vinyl acetate and vinyl benzoate; ethylenic olefins such as ethylene, propylene and butylene; vinyl ketones such as methyl vinyl ketone and hexyl vinyl ketone; and vinyl ethers such as methyl vinyl ether, ethyl vinyl ether and isobutyl vinyl ether. Any of these vinyl monomers may be used alone or in combination, together with the styrene monomer.

As cross-linking agents, compounds having at least two polymerizable double bonds may be chiefly used. For example, they include aromatic divinyl compounds such as divinyl benzene and divinyl naphthalene; carboxylic acid esters having two double bonds, such as ethylene glycol diacrylate, ethylene glycol dimethacrylate and 1,3-butanediol dimethacrylate; divinyl compounds such as divinyl aniline, divinyl ether, divinyl sulfide and divinyl sulfone; and compounds having at least three vinyl groups. Any of these cross-linking agents may be used alone or in combination.

The styrene resins are more preferably usable when they have, in molecular weight distribution as measured by gel permeation chromatography (GPC), a main peak and a sub-peak at least in the regions of a molecular weight of from $0.5\times10^4$ to $5\times10^4$ and a molecular weight of from $1.0\times10^5$ to $5.0\times10^6$. The styrene resins may preferably have a weight-average molecular weight (Mw) of from $1.5\times10^5$ to $3.5\times10^5$, and more preferably from $1.8\times10^5$ to $3.2\times10^5$, as that of tetrahydrofuran(THF)-soluble matter.

In the magnetic toner of the present invention, it is preferred to use an organic metal compound as a charge control agent. Among organic metal compounds, those containing as a ligand or a counter ion an organic compound rich in volatility or sublimity are particularly useful.

Such organic metal compounds include azo type metal complexes represented by the following general formula:

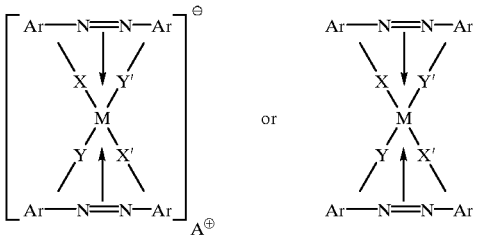

In the above general formula, M represents a central metal of coordination, including Cr, Co, Ni, Mn, Fe, Al, Ti, Sc or V, having a coordination number of 6. Ar represents an aryl group, including a phenyl group or a naphthyl group, which may have a substituent. The substituent includes a nitro group, a halogen atom, a carboxyl group, an anilido group, and an alkyl group or alkoxyl group having 1 to 18 carbon atoms. X, X', Y and Y' each represent —O—, —CO—, —NH— or —NR— (R is an alkyl group having 1 to 4 carbon atoms). $A^+$ represents a hydrogen ion, a sodium ion, a potassium ion, an ammonium ion, an aliphatic ammonium ion or a mixed ion of any of these.

Examples of complexes preferably used in the present invention are shown below.

Formula (a)

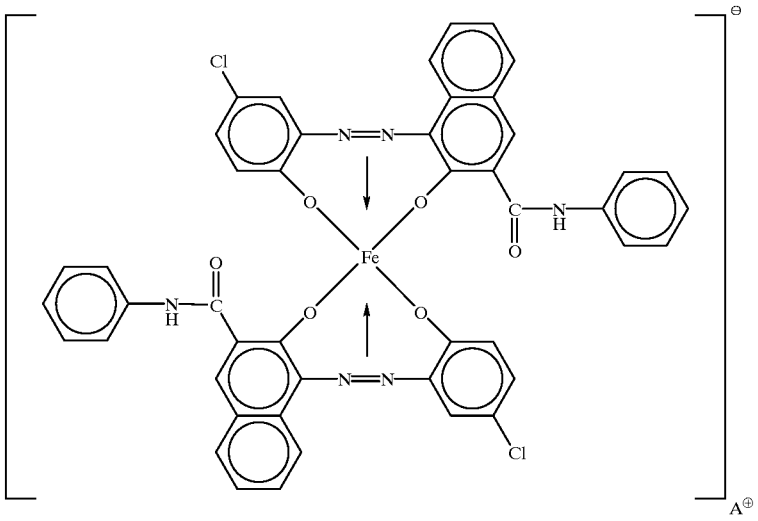

wherein $A^+$ represents $H^+$, $Na^+$, $K^{30}$ , $NH_4^+$, an aliphatic ammonium ion or a mixed ion of any of these.

Formula (b)

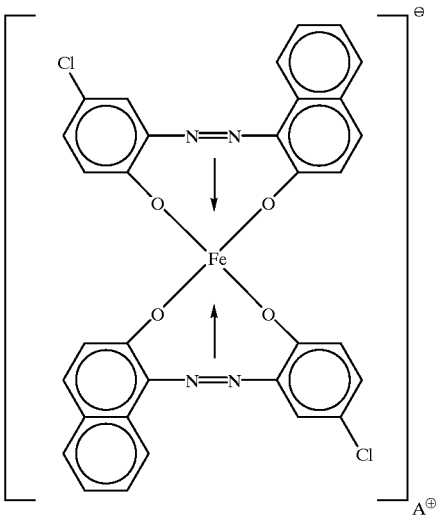

wherein $A^+$ represents $H^+$, $Na^+$, $K^+$, $NH_4^+$, an aliphatic ammonium ion or a mixed ion of any of these.

Formula (c)

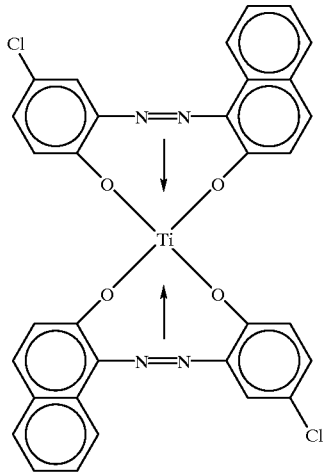

The charge control agent may preferably be added in an amount ranging from 0.2 to 5 parts by weight based on 100 parts by weight of the magnetic toner.

In the magnetic toner, in order to improve charging stability, developing performance, fluidity and running performance, an inorganic fine powder may preferably be externally added to the magnetic toner particles.

The inorganic fine powder may include, e.g., fine silica powder, fine titanium oxide powder and fine aluminum oxide powder. In particular, inorganic fine powders having a specific surface area of 30 $m^2/g$ or more, and particularly in the range of from 50 to 400 $m^2/g$, as measured by nitrogen adsorption according to the BET method, gives good results. The inorganic fine powder may be used in an amount of from 0.01 to 8 parts by weight, and preferably from 0.1 to 5 parts by weight, based on 100 parts by weight of the magnetic toner.

For the purpose of making hydrophobic and controlling chargeability, the inorganic fine powder may also preferably have been optionally treated with a treating agent such as a silicone varnish, various types of modified silicone varnish, a silicone oil, a silane coupling agent, a silane coupling agent having a functional group or other organic silicon compound. The treating agent may be used in a combination of two or more kinds. In particular, a silica fine powder surface-treated with silicone oil is preferred.

As other additives, lubricants such as Teflon, zinc stearate, polyvinylidene fluoride and silicone oil particles (containing about 40% of silica) may preferably be used. Abrasives such as cerium oxide, silicon carbide, calcium titanate and strontium titanate may also preferably be used, and strontium titanate is particularly preferred. Anti-caking agents; conductivity-providing agents such as carbon black, zinc oxide, antimony oxide and tin oxide; and white fine particles and black fine particles having the polarity opposite to that of the magnetic toner particles may also used in a small quantity as developability improvers.

A process for producing the magnetic toner particles used in the magnetic toner will be described below.

In a kneading machine used in the present invention, kneading may preferably be carried out by the use of an extruder in conformity with the mass production of magnetic toner that has been accomplished in recent years. In particular, twin-screw extruders are kneading machines preferred from the viewpoint of quality stability and mass productivity. As specific examples, they may include TEM-100B (manufactured by Toshiba Machine Co., Ltd.) and PCM-87 or PCM-30 (manufactured by Ikegai Corp.).

In the present invention, in the melt-kneading step for forming the magnetic toner particles, it is preferable to melt-knead a mixture having at least the binder resin, the magnetic fine powder and the wax, by means of the kneading machine under the conditions of:

$$2.2\times10^3 \leqq E/\epsilon \leqq 2.0\times10^4$$

$$E=k\omega^2T,\ \epsilon=F/(\pi D^2L)$$

wherein $\omega$ represents a screw rotational speed (m/min), T represents a preset temperature (K), F represents a feed rate (kg/min) of the mixture, D represents a cylinder inner diameter (m), L represents a screw effective length (m), $\pi$ represents the circular constant, and k represents $(D_0/D)^2$, where $D_0$ is 0.1 m.

The reason why the kneading conditions are defined by the value of $E/\epsilon$ is that it is a value effective as an indication according to which the wettability can be judged when the magnetic fine particles constituting the magnetic fine powder are wetted by the binder resin at the time of kneading. It can be said that a larger value of $E/\epsilon$ indicates a higher wettability. The letter symbol E is the product of a value of the square of $\omega$ (a rotational speed of a screw of the kneading machine) and T (a preset temperature), and can be regarded as a value representing the kneading energy of the kneading machine. The symbol $\omega^2$ is a value that correlates with the kinetic energy of the screw, and the preset temperature T is a value that correlates with the heat energy the kneading machine applies. Intending that the state of kneading when feed materials are kneaded by means of the kneading machine is grasped in terms of physical quantity, such state is considered to closely relates with the total sum of the kinetic energy and heat energy applied from the kneading machine. Here, E is expressed as the product $\omega^2T$ so that any difference in the state of kneading can be more clearly grasped.

The letter symbol k is a correction constant. From experience, the wettability has a tendency to be more improved when a kneading machine having a cylinder inner diameter smaller than 0.1 m is used than when a kneading machine having a cylinder inner diameter of 0.1 m is used.

In $\epsilon=F/(\pi D^2L)$, F is a feed material supply quantity per unit time, and $\pi D^2L$ is a value that correlates with the volume in which feed materials can be present in the cylinder of the kneading machine. The letter symbol $\epsilon$ represents how the inside of the cylinder is filled with the feed materials. A large value of $\epsilon$ means that the cylinder is highly filled with the feed materials. If the kneading energy is equal, an instance of a large $\epsilon$ shows that the kneading energy per unit weight in unit time has a tendency to decrease. In fact, the wettability of the magnetic fine powder by the binder resin has a tendency to lower.

As described above, the value of $E/\epsilon$ defines the state of kneading for preparing the fine magnetic toner particles having a weight-average particle diameter of from 3.5 to 6.5 $\mu$m from two viewpoints, the kneading energy and the extent to which the inside of the kneading machine is filled with the feed materials to which the energy is applied, taking note of the parameters, the screw rotational speed, preset temperature, ejection quantity and cylinder inner diameter, which are the bases of kneading conditions.

If the value of $E/\epsilon$ is smaller than $2.2\times10^3$, the wettability of the magnetic fine powder by the binder resin may lower to tend to bring on free magnetic fine particles in the step of pulverization, and the magnetic toner thus obtained tends to cause the charging roller contamination and the melt-adhesion to drum. If the value of $E/\epsilon$ is larger than $2.0\times10^4$, the wax is not dispersed well in the binder resin and tends to cause fog in the environment of low temperature and low humidity.

The range of value of the respective parameters defined as the kneading conditions is determined taking account of the type of kneading machine used.

The letter symbol $\omega$ represents a screw rotational speed (m/min), which is preferably set in the range of from 5 to 50. T represents a preset temperature (K), which is preferably set in the range of from 333 to 513. F represents a feed quantity (kg/min) of the mixture, which is preferably set in the range of from 0.15 to 25. D represents a cylinder inner diameter (m), which is preferably set in the range of from 0.03 to 0.2. L represents a screw effective length (m), which is preferably set in the range of from 1.00 to 4.00. $\pi$ represents the circular constant, and k represents $(D_0/D)^2$, where $D_0$ is 0.1 m.

The value of $E=k\omega^2T$ may preferably be in the range of from $3.0\times10^5$ to $16.0\times10^5$, and the feed rate F of the mixture may preferably be in the range of from 0.30 to 12.00 (kg/min). The value of $\epsilon=F/(\pi D^2L)$ may preferably be in the range of from 85 to 130, and the value of $E/\epsilon$ may preferably be in the range of from $2.5\times10^3$ to $1.5\times10^4$.

When the kneading conditions are set, various manners of constituting kneading paddles of a screw may be thought out. What is preferred is an instance where the conditions are set at two zones, a zone where the melting is started and a zone where the state of dispersion is improved. The kneaded product is subjected to rolling and cooling, crushing, pulverization by a jet stream, and classification by the multi-division system shown in FIG. 7, according to a conventionally known method, thus the magnetic toner particles are obtained. The dispersibility of the magnetic fine powder and wax in the magnetic toner particles can be found by comparing the quantity of magnetic fine powder and quantity of wax in magnetic toner particles of Powder M (FIG. 7) with those in classified fine powder of Powder F.

i) Dispersibility of Magnetic Fine Powder:

The state of dispersion can be found by F/M which is the ratio of value M representing the density of magnetic toner particles in Powder M to value F representing the density of classified fine powder of Powder F, using, e.g., a density analyzer ACUPIC 1330 (trade name; manufactured by Shimadzu Corporation). As the value of F/M more deviates from 1, it can be judged that the magnetic fine particles constituting the magnetic fine powder are not uniformly dispersed in the binder resin.

ii) Dispersibility of Wax:

In a DSC curve prepared by measurement with a differential scanning calorimeter (manufactured by Perkin-Elmer Corporation), with regard to the area surrounded by an endothermic peak curve and the base line, F/M which is the ratio of a value M of the area obtained from the DSC curve of the magnetic toner particles of Powder M to a value F of the area obtained from the DSC curve of the classified fine powder of Powder F is determined, from which how the wax is uniformly dispersed in the binder resin can be found. As the value of F/M more deviates from 1, it can be judged that the wax is not desirably dispersed in the binder resin.

Figure 7:
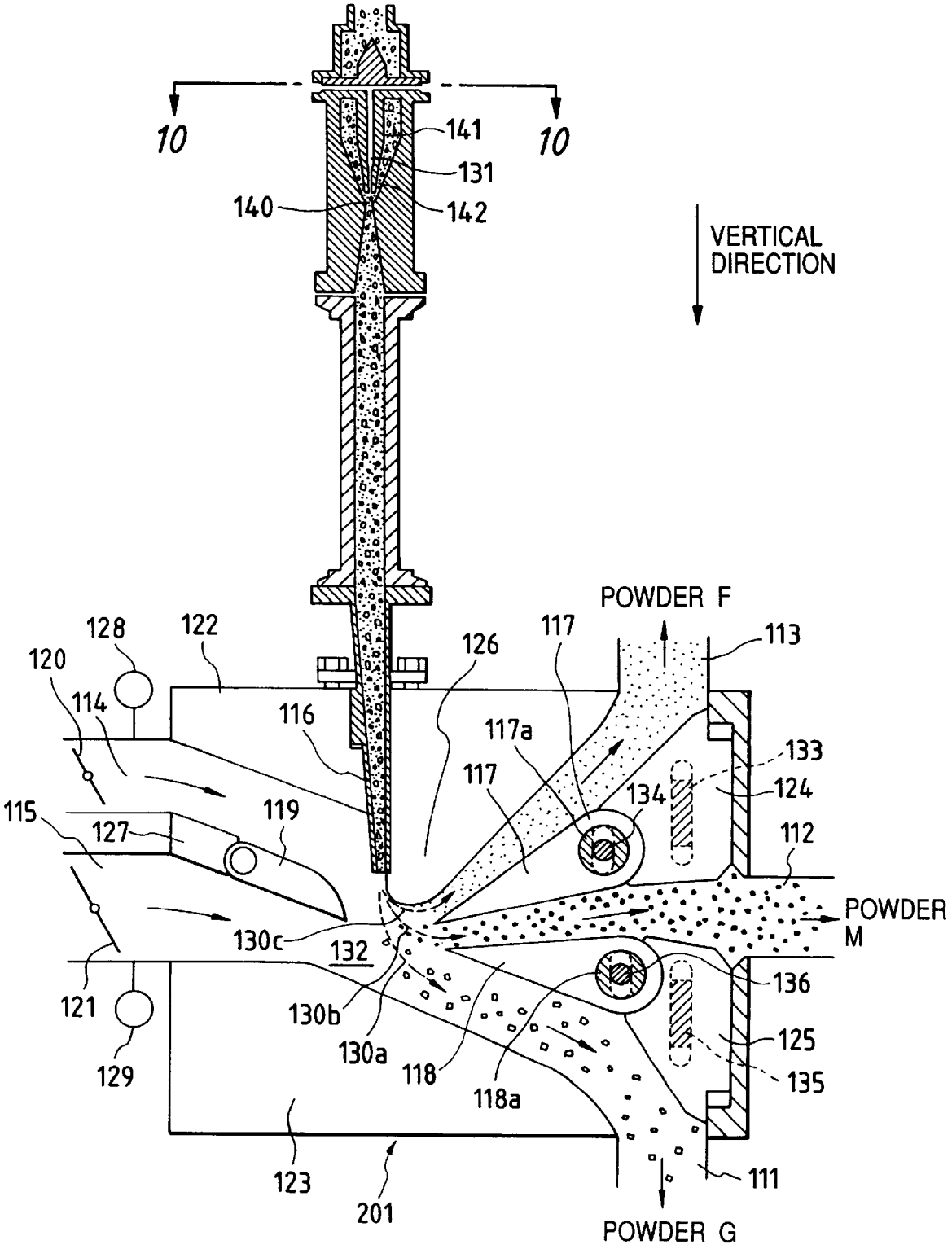
FIG. 7 is a schematic cross-sectional illustration of a gas stream classifier for the multi-divisional classification of magnetic toner particles, which utilizes the Coanda effect.

As an example of a gas stream classifier usable for preparing the magnetic toner particles of the present invention, a type of classifier as shown in FIG. 7 (a cross-sectional view) and FIGS. 8 and 9 (perspective views) will be explained below.

In the gas stream classifier and air classification systems utilizing such a classifier, a feed supply nozzle, which may preferably be provided at an angle of $\theta=45°$ or smaller with respect to the vertical direction, is provided at the rear end thereof with a high-pressure air intake pipe and a feed powder intake nozzle. The feed powder which will be made into magnetic toner particles is supplied from a feed supply opening provided above the feed powder intake nozzle. The feed powder thus supplied is emitted or ejected from the lower part of the feed powder intake nozzle through the periphery of the high-pressure air intake pipe, and is accelerated by the aid of high-pressure air so as to be well dispersed. The feed powder well dispersed can be supplied to the feed supply nozzle. Then, when the form of a classification zone is changed, the classification zone can be made larger in a wide range and also the classification points can be changed in a wide range. Also, the classification points can be adjusted in a good precision without causing disturbance of gas streams around the tips of classifying edges. The principle of suction ejection of feed powder at the feed powder supply part is based on the ejector effect that takes place when the high-pressure air from the high-pressure air intake pipe expands at the feed supply nozzle to produce a vacuum.

Figure 8:
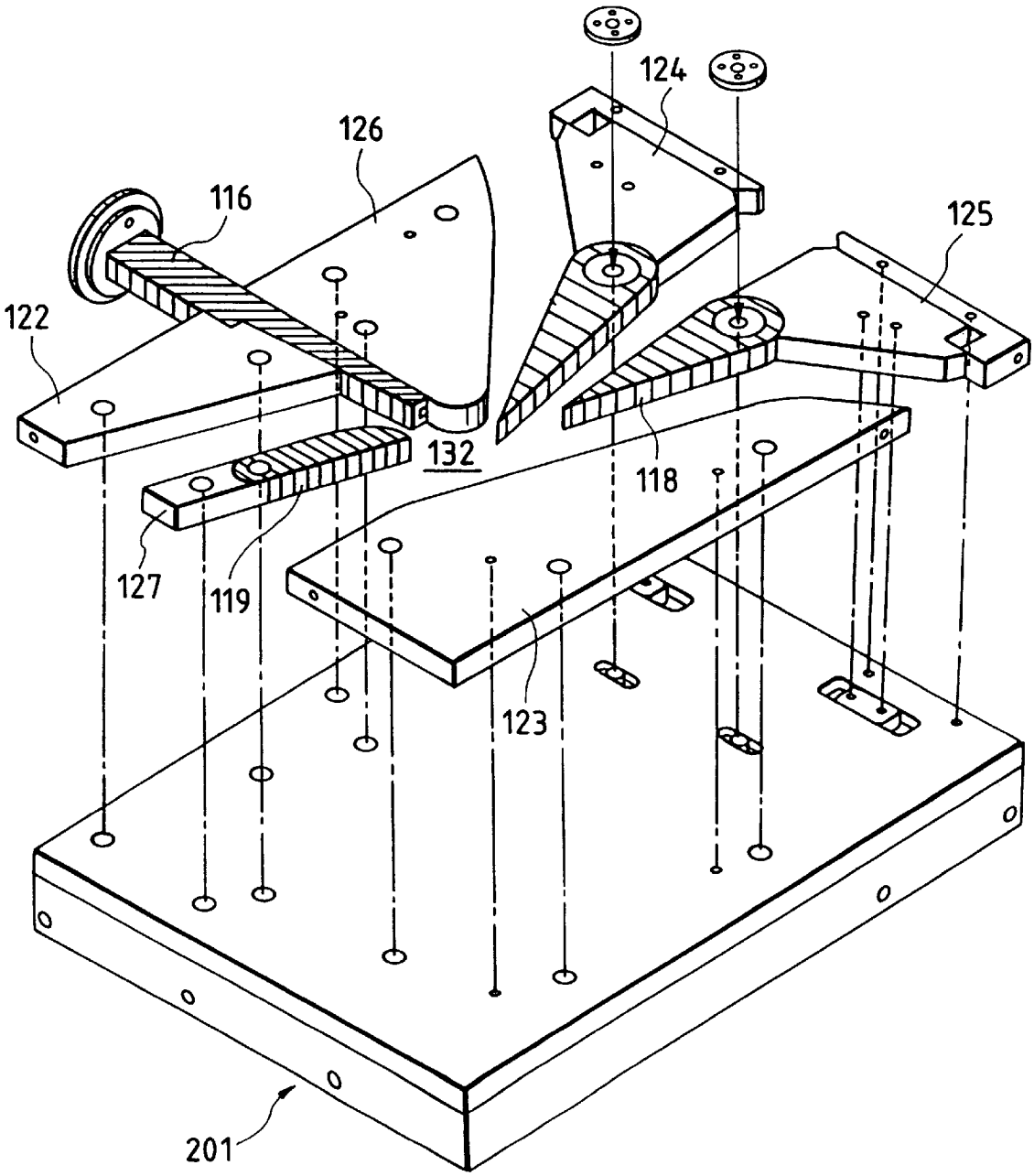
FIG. 8 is a perspective view of the main part of the gas stream classifier shown in FIG. 7.
Figure 9:
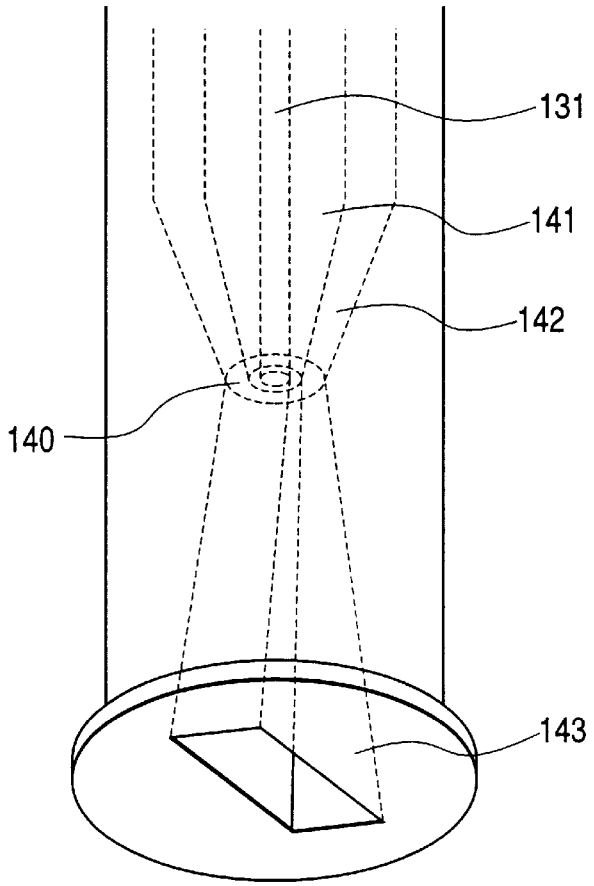
FIG. 9 is a partial perspective view of the gas stream classifier shown in FIG. 7.
Figure 10:
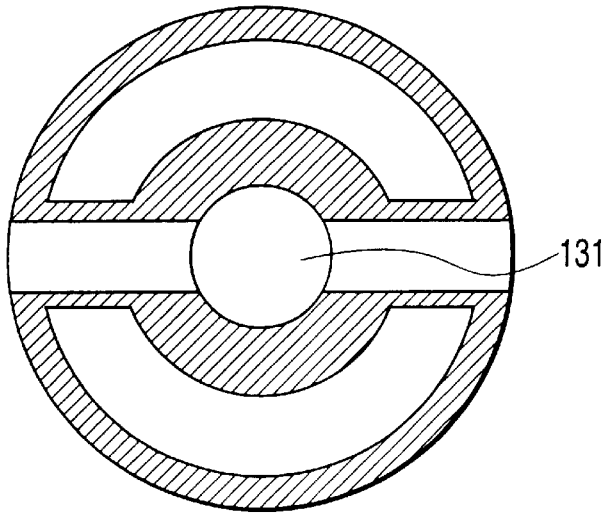
FIG. 10 is a cross section along line 10—10 in FIG. 7.

In the classifier shown in FIGS. 7, 8 and 9, sidewalls 122 and 123 form part of the classifying chamber, and classifying edge blocks 124 and 125 have classifying edges 117 and 118, respectively. The classifying edges 117 and 118 stand swing-movable around shafts 117*a* and 118*a*, respectively, and thus the tip position of each classifying edge can be changed by the swinging of the classifying edge. The respective classifying edge blocks 124 and 125 are so set up that their locations can be slided up and down. As they are slided, the corresponding knife-edge type classifying edges 117 and 118 are also slided up and down. These classifying edges 117 and 118 divide the classification zone of the classifying chamber 132 into three sections.

The classifier has a feed supply opening 140 for introducing the feed powder, provided at the rearmost end of a feed supply nozzle 116, and has, at the rear of the feed supply nozzle 116, a high-pressure air intake pipe 141 and a feed powder intake nozzle 142 having a feed powder supply portion. Also, the feed supply nozzle 116, having an opening to a classifying chamber 132, is provided on the right side of a sidewall 122. A Coanda block 126 is provided so as to form a long elliptic arc with respect to the direction of an extension of the right-side tangential line of the feed supply nozzle 116. A left-side block 127 of the classifying chamber 132 is provided with a knife edge-shaped air-intake edge 119 in the left-side direction of the classifying chamber 132, and is further provided, on the left side of the classifying chamber 132, with air-intake pipes 114 and 115 opening into the classifying chamber 132. The air-intake pipes 114 and 115 are provided with a first gas feed control means 120 and a second gas feed control means 121, respectively, comprising, e.g., a damper, and are also provided with static pressure gauges 128 and 129, respectively.

The high-pressure air introduced into the high-pressure air intake pipe 141 may be at a pressure of from 1.0 to 3.0 $kg/cm^2$ in usual classification. In order to liberate and remove in a good efficiency the magnetic fine particles adhering to the surfaces of magnetic toner particles, the high-pressure air may be higher than 3.0 $kg/cm^2$, and may preferably be at a pressure of from 3.5 to 6.0 $kg/cm^2$. The locations of the classifying edges 117 and 118 and the air-intake edge 119 are adjusted according to types of magnetic toner particles and also according to desired particle size.

On the right side of the classifying chamber 132, discharge outlets 111, 112 and 113 opening into the classifying chamber are provided correspondingly to the respective fraction zones. The discharge outlets 111, 112 and 113 are connected with communicating means such as pipes, and may be respectively provided with shutter means such as valve means.

The feed supply nozzle 116 comprises a rectangular pipe section and a tapered or convergent pipe section, and the ratio of the inner diameter of the rectangular pipe section to the inner diameter of the narrowest part of the convergent pipe section may be set at from 20:1 to 1:1, and preferably from 10:1 to 2:1, to give a good feed velocity.

The classification in the multi-division classifying zone having the above construction is operated, for example, in the following way. The inside of the classifying chamber is evacuated through at least one of the discharge outlets 111, 112 and 113. The feed powder is jetted into the classifying chamber 132 through the feed supply nozzle 116 at a flow velocity of preferably from 50 to 300 m/sec, utilizing the gas stream flowing by the aid of high-pressure air and the vacuum pressure, through the path inside the feed supply nozzle 116 opening into the classifying chamber.

Magnetic toner particles in the feed powder fed into the classifying chamber are moved to draw curves 130*a*, 130*b* and 130*c* by the action attributable to the Coanda effect of the Coanda block 26 and the action of gases such as air concurrently flowed in, and are classified according to the particle size and inertia force of the individual particles in such a way that larger particles (coarse particles) are classified to the outer division (i.e., the outer-side first division of the classifying edge 118), median particles are classified to the second division defined between the classifying edges 118 and 117, and smaller particles are classified to the third division at the third division on the inner side of the classifying edge 117. Powder G comprised of the larger particles, Powder M comprised of the median particles and Powder F comprised of the smaller particles which have been thus classified are discharged from the discharge outlets 111, 112 and 113, respectively.

In the classification of the magnetic toner particles, the classification points chiefly depend on the tip positions of the classifying edges 117 and 118 with respect to the lower end of the Coanda block 126 where the feed powder is jetted out into the classifying chamber 132. The classification points are also affected by the flow rate of classification gas streams or the velocity of the magnetic toner particles jetted out of the feed supply nozzle 116.

In the gas stream classifier, the feed powder is supplied from the feed powder supply opening 140. The feed powder thus supplied is emitted or ejected from the lower part of the feed powder intake nozzle 142 through the periphery of the high-pressure air intake pipe 141, and is accelerated with the aid of high-pressure air so as to be well dispersed. The feed powder is instantaneously introduced into the classifying chamber from the feed supply nozzle 116, classified there and then discharged outside the system of the classifier. Hence, it is important for the feed powder introduced into the classifying chamber, to fly with a driving force in such a state that the agglomerated powder has been dispersed into primary particles, without causing disturbance of the loca of individual particles because of the head portion at which the powder is introduced from the feed supply nozzle 116 into the classifying chamber. When the feed powder is introduced from the upper part, the particles flow downward through the path of the feed supply nozzle 116. Upon the introduction of the flow of toner particles into the classifying chamber 132 having the Coanda block 26 on the lateral side of the orifice of the feed supply nozzle 116, the particles are dispersed according to the size of particles to form particle streams, without disturbance of the flying loca of particles. Thus, the classifying edges are shifted in the direction along their streamlines and then the tip positions of the classifying edges are set stationary, so that they can be set at the predetermined classification points. When these classifying edges 117 and 118 are shifted, they are shifted concurrently with the shift of the classifying edge blocks 124 and 125, whereby the classifying edges can be shifted along the stream directions of particles flying along the Coanda block 126.

Figure 11:
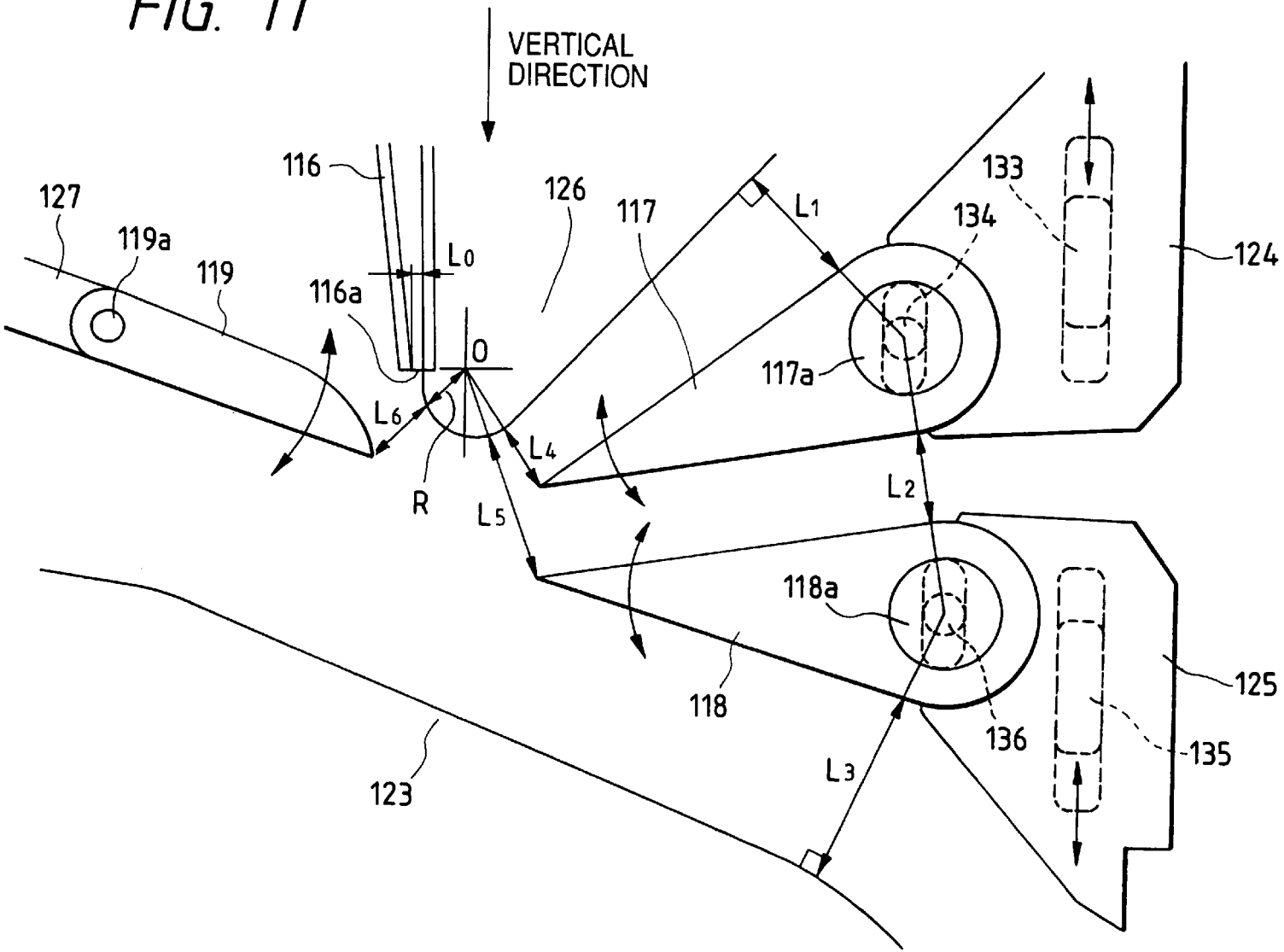
FIG. 11 illustrates the main part of the gas stream classifier shown in FIG. 7.

This will be described more specifically with reference to FIG. 11. Position O, for example, in the Coanda block 126, which corresponds to the side position of the orifice 116*a* of the feed supply nozzle 116, is assumed as the center, where a distance $L_4$ between the tip of the classifying edge 117 and the side of the Coanda block 126 and a distance $L_1$ between the side of the classifying edge 117 and the side of the Coanda block 126 can be adjusted by shifting up and down the classifying edge block 124 along the locating member 133 so that the classifying edge 117 is shifted up and down along the locating member 134, and also by swing-moving the tip of the classifying edge 117 around the shaft 117*a*.

Similarly, a distance $L_5$ between the tip of the classifying edge 118 and the sidewall of the Coanda block 126 and a distance $L_2$ between the side of the classifying edge 117 and the side of the classifying edge 118 or a distance $L_3$ between the side of the classifying edge 118 and the side of a sidewall 123 can be adjusted by shifting up and down the classifying edge block 125 along the locating member 138 so that the classifying edge 118 is shifted up and down along the locating member 136, and also by swing-moving the tip of the classifying edge 118 around the shaft 118*a*.

The Coanda block 126 and the classifying edges 117 and 118 are provided on a side position of the orifice 116*a* of the feed supply nozzle 116, and the classification zone of the classifying chamber is made larger as the set-up locations of the classifying edge block 124 and/or the classifying edge block 125 are changed. Thus, the classification points can be adjusted with ease and in a wide range.

Hence, the disturbance of streams that may be caused by the tips of the classifying edges can be prevented, and the flying velocity of particles can be increased to more improve the dispersion of feed powder in the classification zone, by adjusting the flow rates of suction streams produced by the evacuation through discharge pipes 111*a*, 112*a* and 113*a*. Thus, not only a good classification precision can be achieved even in a high powder concentration and the yield of particles to be obtained as products can be prevented from lowering, but also a better classification precision and an improvement in the yield of products can be achieved even in the same dust concentration.

A distance $L_6$ between the tip of the air-intake edge 119 and the wall surface of the Coanda block 126 can be adjusted by swing-moving the tip of the air-intake edge 119 around the shaft 119*a*. Thus, the classification points can be further adjusted by controlling the flow rate and flow velocity of air or gases flowing from the air-intake pipes 114 and 115.

The set-up distances described above are appropriately determined according to the properties of feed powders. In the case of magnetic toner particles having a true density higher than 1.4 g/cm$^3$ the set-up locations of the classifying edge blocks respectively having the classifying edges and changeable in their set-up locations may preferably be so set as to fulfill the following conditions:

$$L0>0,\ L_1>0,\ L_2>0,\ L_3>0$$

$$L0<L_3<L_1+L_2$$

wherein;

L0 represents a width-direction diameter (mm) of the discharge orifice of the feed supply nozzle;

$L_1$ represents a distance (mm) between the side of a first classifying edge for dividing the feed powder into the median powder fraction and the fine powder fraction and the side of the Coanda block provided opposite thereto;

$L_2$ represents a distance (mm) between the side of the first classifying edge and the side of a second classifying edge for dividing the feed powder into the coarse powder fraction and the median powder fraction; and $L_3$ represents a distance between the side of the second classifying edge and the side of a sidewall standing opposite thereto.

When this condition is fulfilled, magnetic toner particles having a sharp particle size distribution can be obtained in a good efficiency.

Figure 12:
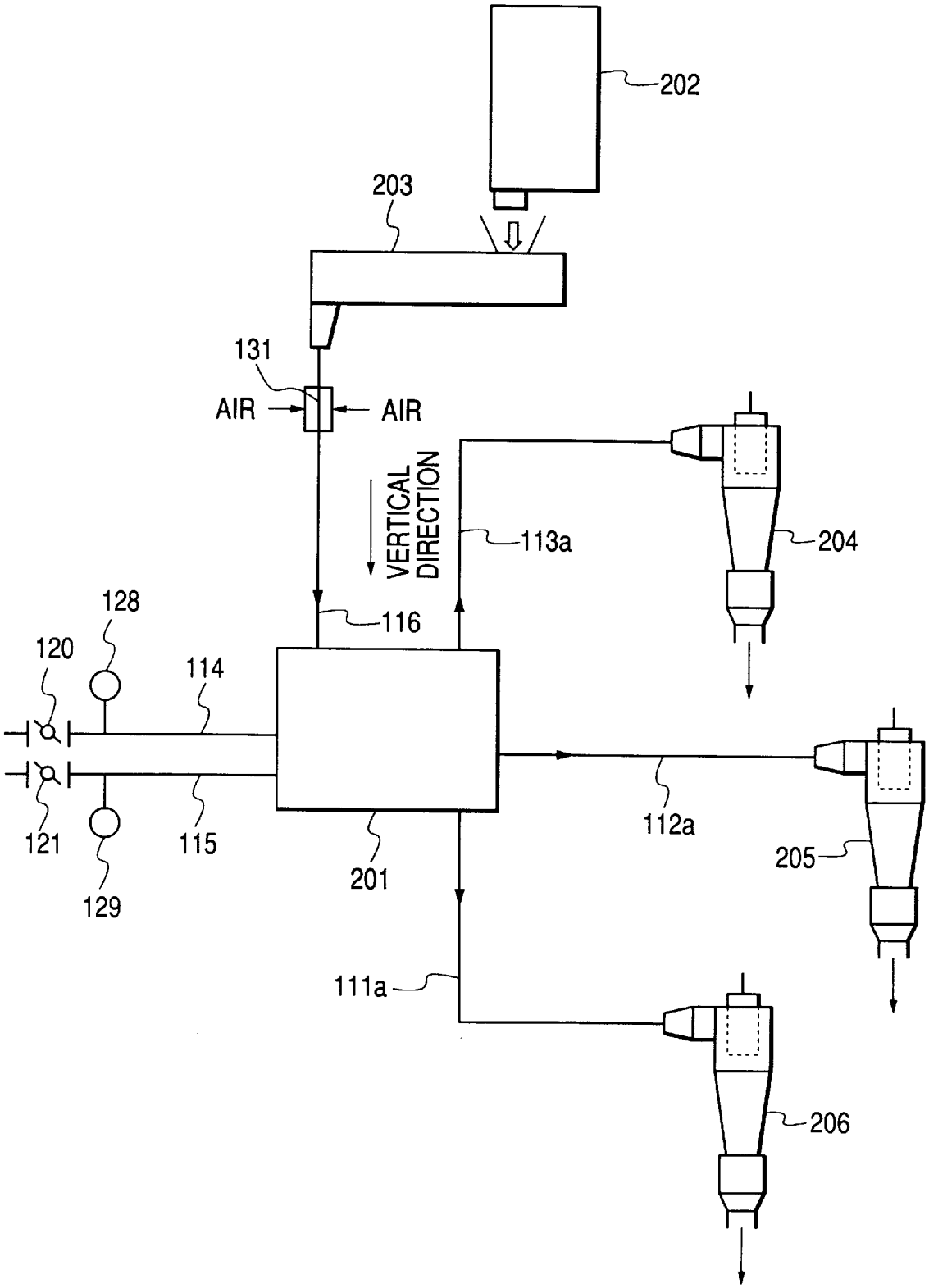
FIG. 12 illustrates an example of a classification process used in the classification of magnetic toner particles.

The gas stream classifier is usually used as a component unit of a unit system in which correlated equipments are connected through communicating means such as pipes. A preferred example of such a unit system is shown in FIG. 12. In the unit system as illustrated in FIG. 12, a three-division classifier 1 (the classifier as illustrated in FIGS. 7 and 8), a continuous-rate feeder 202, a vibrating feeder 203, and collecting cyclones 204, 205 and 206 are all connected through communicating means.

In this unit system, the feed powder is fed into the continuous-rate feeder 202 through a suitable means, and then introduced into the three-division classifier 201 from the vibrating feeder 203 through the feed supply nozzle 116. When introduced, the feed powder may be fed into the three-division classifier 201 at a flow velocity of 50 to 300 m/sec. The classifying chamber of the three-division classifier 201 is constructed usually with a size of [10 to 50 cm]×[10 to 50 cm], so that the feed powder can be instantaneously classified in 0.1 to 0.01 seconds or less, into three or more fractions of particles. Then, the feed powder is classified by the three-division classifier 201 into a fraction of larger particles (coarse particles), a fraction of median particles and a fraction of smaller particles. Thereafter, the larger particles are passed through a discharge guide pipe 111*a*, and sent to and collected in the collecting cyclone 206. The median particles are discharged outside the system through the discharge pipe 112*a*, and collected in the collecting cyclone 205. The smaller particles are discharged outside the system through the discharge pipe 113*a* and collected in the collecting cyclone 204. The collecting cyclones 204, 205 and 206 may also function as suction evacuation means for suction-feeding the feed powder to the classifying chamber through the feed supply nozzle 116.

An example of the image forming method making use of the magnetic toner of the present invention will be described with reference to FIG. 4.

A contact charging means 2, to which a voltage has been applied by a bias applying means E, negatively charges the surface of an electrostatic image bearing member (a photosensitive drum 1). The drum surface is exposed to laser light 3 to form a digital latent image by image scanning. The latent image thus formed is reverse-developed using a magnetic toner 13 held in a developing assembly 4 having an elastic blade 6 and a developing sleeve 5 internally provided with a magnet. In the developing zone, a conductive substrate of the photosensitive drum 1 is earthed and an AC bias, a pulse bias and/or a DC bias is/are applied to the developing sleeve 5 through a bias applying means 8.

A transfer-receiving medium P is fed and delivered to the transfer zone, where the transfer-receiving medium P is electrostatically charged by a voltage applying means 10 from its back surface (the surface opposite to the photosensitive drum) through a roller transfer means 9, so that the developed image (a toner image) on the surface of the photosensitive drum 1 is transferred to the transfer-receiving medium P by the roller transfer means 4. The transfer-receiving medium P separated from the photosensitive drum 1 is subjected to fixing using a heat-pressure roller fixing assembly 12 so that the toner image on the transfer-receiving medium P is fixed.

When the magnetic toner remaining on the photosensitive drum 1 after the transfer step is in a small quantity, the step of cleaning may be omitted. After the cleaning by a cleaning means 11, the photosensitive drum 1 is again repeatedly subjected to the procedure again starting from the charging step using the contact charging means 2.

The photosensitive drum 1 comprises a photosensitive layer and a conductive substrate, and is rotated in the direction of an arrow. In the developing zone, a developing sleeve 5 formed of a non-magnetic cylinder, which is a toner carrying member, is rotated so as to move in the same direction as the direction in which the photosensitive drum 1 is rotated. Inside the developing sleeve 5, a multi-polar permanent magnet (magnet roll) serving as a magnetic-field generating means is provided in an unrotatable state. The magnetic toner 13 held in the developing assembly 4 is applied onto the surface of the non-magnetic cylinder (developing sleeve), and, for example, minus triboelectric charges are imparted to the magnetic toner because of the friction between the surface of the developing sleeve 5 and the magnetic toner. An elastic blade 6 is also disposed closely to the surface of the cylinder (distance: 50 $\mu$m to 500 $\mu$m) and facing the position of one pole of the multi-polar magnet. Thus, the thickness of magnetic toner layer is controlled to be small (30 $\mu$m to 300 $\mu$m) and uniform so that a magnetic toner layer smaller in thickness than the gap between the photosensitive drum 1 and the developing sleeve 5 in the developing zone is formed. The rotational speed of this developing sleeve 5 is regulated so that the peripheral speed of the sleeve can be substantially equal or close to the speed of the peripheral speed of the photosensitive drum. A blade made of iron may be used as the elastic blade 6.

In the developing zone, an AC bias or a pulse bias may be applied to the developing sleeve 5 through a bias means 8. This AC bias may have a frequency (f) of from 200 to 4,000 Hz and a Vpp of from 500 to 3,000 V.

When the magnetic toner is moved in the developing zone, the magnetic toner is moved to the side of the electrostatic image by the electrostatic force of the surface of the photosensitive drum and the action of the AC bias or pulse bias.

The elastic blade 6 is formed of an elastic material such as silicone rubber, and the layer thickness of the magnetic toner is regulated by pressing with the elastic blade 6 to coat the magnetic toner 13 on the developing sleeve 5.

Figure 5:
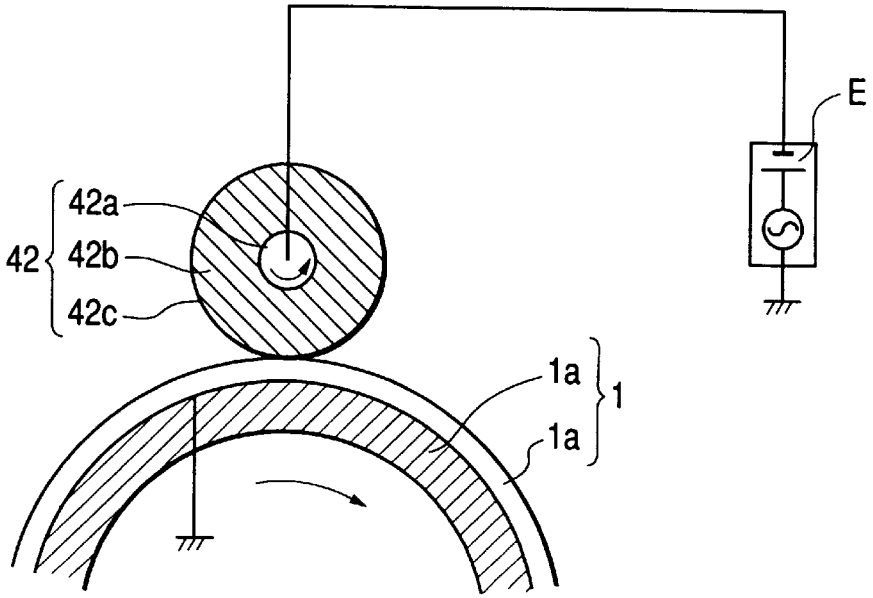
FIG. 5 is a schematic illustration of a contact charging means preferably used in the present invention.

FIG. 5 illustrates the constitution of a charging roller which is one embodiment of the contact charging means preferably used in the present invention.

Reference numeral 42 denotes the charging roller, which is basically comprised of a mandrel 42*a* at the center and a conductive elastic layer 42*b* and a surface layer that form the periphery of the mandrel. The charging roller 42 is brought into pressure contact with the surface of the photosensitive drum 1 at a given pressure, and is rotated followingly as the photosensitive drum 1 is rotated. The photosensitive drum 1 is formed of layers basically comprised of a conductive substrate layer 1*a* made of a conductive metal such as aluminum and a photoconductive layer 1*b* formed on its periphery, and is clockwise rotated as viewed in the drawing, at a given peripheral speed (process speed). To the charging roller 42, a voltage is applied by the bias applying means E. Application of a bias to the charging roller 42 causes the surface of the photosensitive drum 1 to be charged to given polarity and potential. Imagewise exposure subsequently carried out forms electrostatic latent images. The electrostatic latent images are developed by a developing means and successively converted into visible images as toner images.

When the charging roller is used, the charging process may preferably be performed under conditions of a roller contact pressure of from 5 to 500 g/cm; an AC voltage of from 0.5 to 5 kVpp, an AC frequency of from 50 to 5 kHz and a DC voltage of from ±0.2 to ±1.5 kV when an AC voltage is superimposed on a DC voltage; and a DC voltage of from ±0.2 to ±5 kV when only a DC voltage is applied.

The charging roller may preferably be made of a conductive rubber, e.g., ethylene-propylene-diene terpolymer (EPDM), and a release coat may be provided on its surface. The release coat may be formed of nylon resin, polyvinylidene fluoride (PVDF) or polyvinylidene chloride (PVDC), which may preferably be used.

The process cartridge of the present invention will be described below with reference to FIG. 6.

The process cartridge of the present invention has at least a developing means and an electrostatic image bearing member which are held into one unit as a cartridge, and the process cartridge is so set up as to be detachable from the main body of an image forming apparatus (e.g., a copying machine or a laser beam printer).

Figure 6:
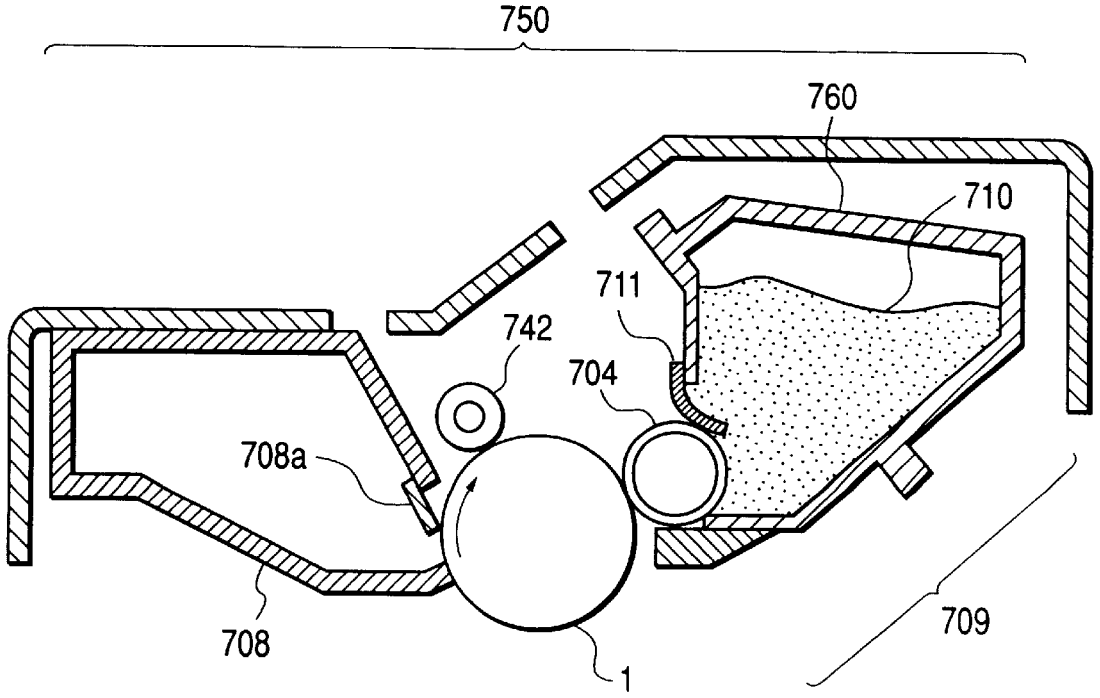
FIG. 6 is a schematic illustration of an example of the process cartridge of the present invention.

The embodiment shown in FIG. 6 exemplifies a process cartridge 750 having a developing means 709, a drum type electrostatic image bearing member (a photosensitive drum) 1, a cleaning means 708 having a cleaning blade 708*a* and a contact charging means 742 serving as a primary charging means, which are held into one unit.

In this embodiment, the developing means 709 has an elastic regulation blade 711 and a toner container 760 holding a magnetic toner 710. At the time of development using the magnetic-toner 710, a given electric field is formed between the photosensitive drum 1 and a developing sleeve 704 serving as a toner carrying member, by a bias voltage applied from a bias applying means to carry out the development. In order to preferably carry out the development, the distance between the photosensitive drum 1 and the developing sleeve 704 is adjusted.

In the foregoing, the embodiment is described in which the developing means 709, the electrostatic image bearing member 1, the cleaning means 708 and the primary charging means 742 are held into one unit as a cartridge. In the present invention, at least two constituents, the developing means and the electrostatic image bearing member, may be held into one unit as a cartridge. At least three constituents, the developing means, the electrostatic image bearing member and the primary charging means, may also be held into one unit as a cartridge, or other constituent(s) may be added thereto.

The present invention will be described below in greater detail by giving the following Examples.

| Example 1 | | (by weight) |
|---|---|---|
| (i) | Binder resin | 100 parts |

a) Styrene-n-butyl acrylate copolymer (copolymerization ratio: 80:20)
b) In GPC, having a main peak at molecular weight of 15,000 and a subpeak at molecular weight of 650,000
c) Weight-average molecular weight (Mw): 250,000

| (ii) | Magnetic fine powder | 100 parts |
|---|---|---|

a) Number-average particle diameter R: 0.20 $\mu$m
b) Shape of magnetic fine particles: spherical
c) $\sigma r$: 5.9
d) Hc: 6.4
e) $\sigma r \times Hc$: 38 ($kA^2m/kg$)
f) W of silicon dioxide present on the surfaces of magnetic fine particles: 0.13% by weight
g) W×R: 0.024

| (iii) | Negative charge control agent | 2 parts |
|---|---|---|

a) Monoazo complex represented by Formula (a) previously set out
b) Counter ions: $H^+$, $Na^+$, $NH_4^+$

| (iv) | Wax | 5 parts |
|---|---|---|

a) Long-chain alkyl alcohol wax
b) Average value of carbon atom number: 50
c) Softening point: 98° C.
d) Measurement of softening point: DSC endothermic peak temperature The above materials were mixed using a Henschel mixer to obtain a mixture. The mixture obtained was put into a twin-screw extruder (machine type: TEM-100B, manufactured by Toshiba Machine Co., Ltd.), and the mixture was melt-kneaded under kneading conditions B shown in Table 1. Immediately after the kneading was completed, the kneaded product obtained had a temperature of 156° C. The kneaded product was crushed by means of a hammer mill, and the crushed product obtained was finely pulverized using an impact type pneumatic pulverizer making use of a jet stream to obtain a finely pulverized product.

In the classification system as shown in FIG. 12, the pulverized product thus obtained was introduced into the multi-division classifier 201 shown in FIG. 7, through the feeder 202 and also through the vibrating feeder 203 and the feed supply nozzle 116, in order to classify the pulverized product into the three fractions, coarse powder fraction G, median powder fraction M and fine powder fraction F, at a rate of 360 kg/h by utilizing the Coanda effect.

The pulverized product was introduced by utilizing the suction force derived from the reduced pressure of the inside of the system by suction evacuation through collecting cyclones 204, 205 and 206 communicating with discharge outlets 111, 112 and 113, respectively, and utilizing the compressed air (pressure: 1.5 $kg/cm^2$) fed through a injection nozzle 131 attached to the feed supply nozzle 116.

To change the form of the classification zone, the respective location distances shown in FIG. 11 were set as shown below, carrying out classification.

L0: 6 mm (the width-direction diameter of the feed supply nozzle discharge orifice 116*a*
$L_1$: 32 mm (the distance between the side of a classifying edge 117 and the side of the Coanda block 126)
$L_2$: 33 mm (the distance between the side of the classifying edge 117 and the side of the classifying edge 118)
$L_3$: 39 mm (the distance between the side of the classifying edge 118 and the surface of the sidewall 123)
$L_4$: 18 mm (the distance between the tip of the classifying edge 117 and the side of the Coanda block 126)
$L_5$: 33 mm (the distance between the tip of the classifying edge 118 and the side of the Coanda block 126)
$L_6$: 25 mm (the distance between the tip of the air-intake edge 119 and the side of the Coanda block 126)
R: 14 mm (the radius of the arc of the Coanda block 126)

The pulverized product thus introduced was instantaneously classified in 0.1 second or less.

The median powder fraction M, which is used as the magnetic toner particles, had a weight-average particle diameter (D4) of 5.7 $\mu$m, an absorbance of 0.55, a shape factor SF-1 of 154, a shape factor SF-2 of 143 and a value of SF-1/SF-2 of 1.08.

Physical properties of the magnetic toner particles thus obtained are shown in Table 2. The state of dispersion of the magnetic fine powder and the state of dispersion of the wax are also shown in Table 3.

100 parts by weight of magnetic toner particles obtained and 1.5 parts by weight of hydrophobic fine silica powder having been surface-treated with a silane coupling agent and dimethylsilicone oil (BET specific surface area: 110 $m^2/g$) were mixed to prepare a negatively chargeable magnetic toner.

Figure 4:
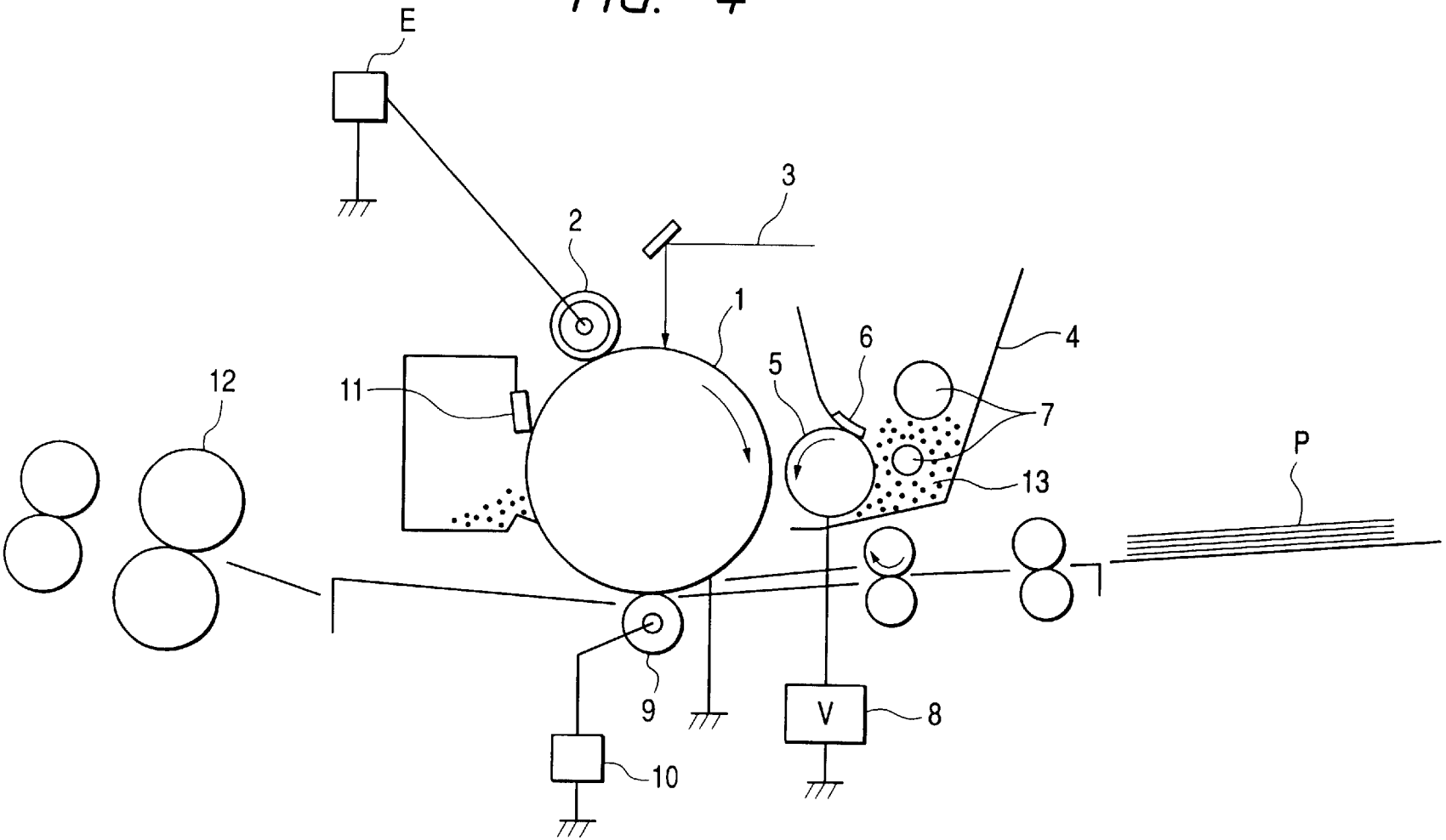
FIG. 4 is a schematic illustration of an example of an electrophotographic apparatus employing the magnetic toner of the present invention.

To carry out the image forming method shown in FIG. 4 and evaluate the performances of the magnetic toner, the magnetic toner thus prepared was put into a developing assembly of a process cartridge used for a laser beam printer (trade name: LBP-450, manufactured by CANON INC.) in which electrostatic images are developed by reversal development. The process cartridge was attached to the laser beam printer to make an image reproduction test in each environment.

The image quality of dot latent images was also evaluated using the laser beam printer modified so as to have a resolution of 1,200 dpi.

Results of the evaluation are shown in Tables 4-1, 4-2 and 4-3.

EVALUATION METHODS (a) Image Density:

Image densities of solid black images at the initial stage (2nd sheet) and on 3,000th sheet and 6,000th sheet were evaluated using a Macbeth densitometer (b) Fog:

Using "Reflectometer" (manufactured by Tokyo Denshoku K.K.), the whiteness of transfer-receiving paper before printing was beforehand measured, and the whiteness of white image areas of a print obtained was determined. Indicated as the value at which the difference between them comes to be maximum.

(c) Charging Roller Contamination:

After 6,000 sheet running, evaluation was made on halftone images, which tend to cause faulty images due to faulty charging.

Rank 5: No faulty images occur which are caused by the contamination of the contact charging roller Rank 3: Faulty images caused by the contamination of the contact charging roller are seen to occur, but at a level not problematic in practical use.

Rank 1: Faulty images caused by the contamination of the contact charging roller are seen to occur, and the faulty images are at a level problematic in practical use.

Rank 4 is a level intermediate between Ranks 5 and 3. Rank 2 is a level intermediate between Ranks 3 and 1.

(d) Dot Images of 600 dpi:

On the image reproduction conditions that dot latent images of 600 dots per inch can be formed, one-dot toner images were formed. The toner images formed were magnified and visually evaluated according to the following four ranks.

A: Excellent
B: Good
C: Average
D: Poor (black spots of toner around images are seen to have occurred, or the dot images have distorted shapes.)

(e) Dot Images of 1,200 dpi:

On the image reproduction conditions that dot latent images of 1,200 dots per inch can be formed, one-dot toner images were formed. The toner images formed were magnified and visually evaluated according to the following four ranks.

A: Excellent
B: Good
C: Average
D: Poor (Black spots of toner around line images are seen to have occurred, or the dot images have distorted shapes.)

(f) Melt-adhesion to Drum:

Evaluation was made according to the extent to which white spots caused by deposits adhered to the OPC photosensitive drum surface appear on solid black images after 6,000 sheet running.

Rank 5: No spot appears at all.
Rank 3: Some spots appear, but no problem in practical use.
Rank 1: Many spots appear (tens of spots), and problematic in practical use.

Rank 4 is a level intermediate between Ranks 5 and 3. Rank 2 is a level intermediate between Ranks 3 and 1.

(g) Image Density of Images on the First Sheet in the Morning:

In 1,500 sheets/day running in an environment of high temperature and high humidity, the density of solid black images on the first sheet in the morning on the third day was measured.

EXAMPLE 2

Magnetic toner particles were obtained in the same manner as in Example 1 except that the magnetic fine powder was replaced with one formed of spherical magnetic fine particles with a number-average particle diameter of 0.20 $\mu$m and having the value of $\sigma r \times Hc$ of 22 ($kA^2m/kg$) and the value of W×R of 0.044 and the kneading conditions were changed to conditions A shown in Table 1. The magnetic toner particles thus obtained were mixed with the same hydrophobic fine silica powder as that in Example 1 to prepare a magnetic toner, and images were reproduced and evaluated in the same manner as in Example 1.

Physical properties and so forth of the magnetic toner particles are shown in Tables 2 and 3. The results of evaluation are shown in Tables 4-1, 4-2 and 4-3.

EXAMPLE 3

A magnetic toner was prepared in the same manner as in Example 1 except that the magnetic fine powder was replaced with one formed of spherical magnetic fine particles with a number-average particle diameter of 0.18 $\mu$m and having the value of $\sigma r \times Hc$ of 38 ($kA^2m/kg$) and the value of W×R of 0.044 and the kneading conditions were changed to conditions A shown in Table 1. Evaluation was also made similarly. The magnetic toner particles had an absorbance of 0.64, SF-1 of 155 and SF-2 of 144 and the kneaded product had a temperature of 156° C.

Physical properties and so forth of the magnetic toner particles are shown in Tables 2 and 3. The results of evaluation are shown in Tables 4-1, 4-2 and 4-3.

EXAMPLE 4

A magnetic toner was prepared in the same manner as in Example 1 except that the magnetic fine powder was replaced with one formed of spherical magnetic fine particles with a number-average particle diameter of 0.18 $\mu$m and having the value of $\sigma r \times Hc$ of 38 ($kA^2m/kg$) and the value of W×R of 0.024 and the kneading conditions were changed to conditions A shown in Table 1. Evaluation was also made similarly. The magnetic toner particles had an absorbance of 0.60, SF-1 of 154 and SF-2 of 143 and the kneaded product had a temperature of 156° C.

Physical properties and so forth of the magnetic toner particles are shown in Tables 2 and 3. The results of evaluation are shown in Tables 4-1, 4-2 and 4-3.

EXAMPLE 5

A magnetic toner was prepared in the same manner as in Example 4 except that polyethylene wax (softening point: 130° C.) was used as the wax. Evaluation was also made similarly. The magnetic toner particles had an absorbance of 0.57, SF-1 of 154 and SF-2 of 143 and the kneaded product had a temperature of 154° C.

Physical properties and so forth of the magnetic toner particles are shown in Tables 2 and 3. The results of evaluation are shown in Tables 4-1, 4-2 and 4-3.

EXAMPLE 6

A magnetic toner was prepared in the same manner as in Example 4 except that the kneading conditions were changed to conditions B shown in Table 1. Evaluation was also made similarly. The magnetic toner particles had an absorbance of 0.55, SF-1 of 154 and SF-2 of 143 and the kneaded product had a temperature of 159° C.

Physical properties and so forth of the magnetic toner particles are shown in Tables 2 and 3. The results of evaluation are shown in Tables 4-1, 4-2 and 4-3.

EXAMPLE 7

A magnetic toner was prepared in the same manner as in Example 4 except that the kneading conditions were changed to conditions C shown in Table 1. Evaluation was also made similarly. The magnetic toner particles had an absorbance of 0.50, SF-1 of 155 and SF-2 of 143 and the kneaded product had a temperature of 161° C.

Physical properties and so forth of the magnetic toner particles are shown in Tables 2 and 3. The results of evaluation are shown in Tables 4-1, 4-2 and 4-3.

EXAMPLE 8

A magnetic toner was prepared in the same manner as in Example 4 except that the kneading conditions were changed to conditions D shown in Table 1. Evaluation was also made similarly. The magnetic toner particles had an absorbance of 0.50, SF-1 of 155 and SF-2 of 144 and the kneaded product had a temperature of 161° C.

Physical properties and so forth of the magnetic toner particles are shown in Tables 2 and 3. The results of evaluation are shown in Tables 4-1, 4-2 and 4-3.

EXAMPLE 9

A magnetic toner was prepared in the same manner as in Example 4 except that the kneading conditions were changed to conditions E shown in Table 1. Evaluation was also made similarly. The magnetic toner particles had an absorbance of 0.58, SF-1 of 155 and SF-2 of 143 and the kneaded product had a temperature of 155° C.

Physical properties and so forth of the magnetic toner particles are shown in Tables 2 and 3. The results of evaluation are shown in Tables 4-1, 4-2 and 4-3.

EXAMPLE 10

A magnetic toner was prepared in the same manner as in Example 4 except that the kneading conditions were changed to conditions F shown in Table 1. Evaluation was also made similarly. The magnetic toner particles had an absorbance of 0.52, SF-1 of 154 and SF-2 of 143 and the kneaded product had a temperature of 153° C.

Physical properties and so forth of the magnetic toner particles are shown in Tables 2 and 3. The results of evaluation are shown in Tables 4-1, 4-2 and 4-3.

EXAMPLES 11 to 15

Magnetic toner particles shown in Table 2 were obtained in the same manner as in Example 1 while changing the magnetic fine powder used, the kneading conditions and the classification conditions. The magnetic toner particles thus obtained were mixed with the same hydrophobic fine silica powder as that in Example 1 to prepare magnetic toners, and images were reproduced and evaluated in the same manner as in Example 1.

Physical properties and so forth of the magnetic toner particles are shown in Tables 2 and 3. The results of evaluation are shown in Tables 4-1, 4-2 and 4-3.

COMPARATIVE EXAMPLE 1

A magnetic toner was prepared in the same manner as in Example 2 except that the kneading conditions were changed to conditions G shown in Table 1. Evaluation was also made similarly. The magnetic toner particles had an absorbance of 0.72, SF-1 of 155 and SF-2 of 144 and the kneaded product had a temperature of 152° C.

Physical properties and so forth of the magnetic toner particles are shown in Tables 2 and 3. The results of evaluation are shown in Tables 4-1, 4-2 and 4-3.

COMPARATIVE EXAMPLE 2

A magnetic toner was prepared in the same manner as in Example 2 except that the kneading conditions were changed to conditions H shown in Table 1. Evaluation was also made similarly. The magnetic toner particles had an absorbance of 0.77, SF-1 of 155 and SF-2 of 143 and the kneaded product had a temperature of 153° C.

Physical properties and so forth of the magnetic toner particles are shown in Tables 2 and 3. The results of evaluation are shown in Tables 4-1, 4-2 and 4-3.

COMPARATIVE EXAMPLE 3

A magnetic toner was prepared in the same manner as in Example 2 except that the kneading conditions were changed to conditions I shown in Table 1. Evaluation was also made similarly. The magnetic toner particles had an absorbance of 0.18, SF-1 of 155 and SF-2 of 143 and the kneaded product had a temperature of 160° C.

Physical properties and so forth of the magnetic toner particles are shown in Tables 2 and 3. The results of evaluation are shown in Tables 4-1, 4-2 and 4-3.

COMPARATIVE EXAMPLE 4 to 6

Magnetic toner particles shown in Table 2 were obtained in the same manner as in Example 1 but changing the magnetic fine powder used, the kneading conditions and the classification conditions. The magnetic toner particles thus obtained were mixed with the same hydrophobic fine silica powder as that in Example 1 to prepare magnetic toners, and images were reproduced and evaluated in the same manner as in Example 1.

Physical properties and so forth of the magnetic toner particles are shown in Tables 2 and 3. The results of evaluation are shown in Tables 4-1, 4-2 and 4-3.

| Example 16 | (by weight) |
|---|---|
| Binder resin (a styrene resin) | 100 parts |
| Magnetic fine powder | 100 parts |

Number-average particle diameter: 0.20 $\mu$m
Shape of particles: spherical
$\sigma r \times Hc$: 22 ($kA^2m/kg$)
$W \times R$: 0.044

| | |
|---|---|
| Charge control agent (a monoazo Fe complex) | 2 parts |
| Wax (high-molecular-weight alcohol wax; softening point: 98° C. | 5 parts |

The above materials were mixed and dispersed using a Henschel mixer, and were melt-kneaded under conditions A shown in Table 5. Immediately after the kneading was completed, the kneaded product obtained had a temperature of 156° C. The kneaded product was cooled, and thereafter crushed, and the crushed product obtained was finely pulverized using a pulverizer making use of a jet stream. The pulverized product was further classified using Elbow Jet Classifier (manufactured by Nittetsu Kogyo K.K.) to obtain magnetic toner particles with a weight average particle diameter (D4) of 5.7 $\mu$m. Their absorbance measured by the wettability test was 0.65.

To 100 parts by weight of the magnetic toner particles, 1.5 parts by weight of fine silica powder subjected to hydrophobic treatment was mixed to prepare a magnetic toner.

A laser beam printer (trade name: LBP-450, manufactured by CANON INC.) was modified and used as an image reproduction test machine. The process cartridge shown in FIG. 6 was used as a cartridge for image reproduction. The above magnetic toner was put into this cartridge, and images were reproduced and evaluated.

In the present Example, the charging roller shown in FIG. 5 was set in the process cartridge to carry out primary charging. The charging roller 42 had an outer diameter of 12 mm. EPDM was used in the conductive rubber layer 42*b*, and a 10 $\mu$m thick nylon resin in the surface layer 42*c*. Letter symbol E denotes a power source for applying a voltage to this charging roller, which applies a predetermined voltage to the mandrel 42*a* of the charging roller 42. In FIG. 5, E is an AC voltage superimposed on a DC voltage.

The photosensitive drum was charged by the charging roller 42 so as to effect primary charging at −650 V. A gap was provided in non-contact between the photosensitive drum and the magnetic toner layer on the developing sleeve (internally provided with a magnet), and electrostatic images were developed by reverse development while applying an AC bias (f: 2,200 Hz; Vpp: 1,600 V) and a DC bias ($V_{DC}$: −500 V) to the developing sleeve, under $V_L$ set at −170 V.

Thus, magnetic toner images were formed on the OPC photosensitive drum.

The magnetic toner images thus formed were transferred to plain paper at the above plus transfer potential, and the plain paper having thereon the magnetic toner images was passed through a heat-and-pressure roller type fixing assembly to fix the magnetic toner images.

Results obtained are shown in Table 6.

EXAMPLE 17

A magnetic toner with D4 of 5.7 $\mu$m was prepared in the same manner as in Example 16 except that the magnetic fine powder was replaced with one formed of spherical magnetic fine particles with a number-average particle diameter of 0.18 $\mu$m and having the value of $\sigma r \times Hc$ of 38 ($kA^2m/kg$) and the value of $W \times R$ of 0.044. Evaluation was also made similarly. The magnetic toner particles had an absorbance of 0.64 in the wettability test.

Results obtained are shown in Table 6.

EXAMPLE 18

Using the same magnetic toner as that used in Example 17, evaluation was made in the same manner as in Example 17 except that an EPDM foam was used as the conductive rubber layer of the charging roller.

Results obtained are shown in Table 6.

EXAMPLE 19

Using the same magnetic toner as that used in Example 17, evaluation was made in the same manner as in Example 17 except that an acrylic resin material with a fluorine resin dispersed therein was used as the surface layer of the charging roller.

Results obtained are shown in Table 6.

EXAMPLE 20

A magnetic toner was prepared in the same manner as in Example 2 except that the kneading conditions were changed to conditions B shown in Table 5. Evaluation was made in the same manner as in Example 19.

Results obtained are shown in Table 6.

COMPARATIVE EXAMPLE 7

A magnetic toner was prepared in the same manner as in Example 16 except that the kneading conditions were changed to conditions C shown in Table 5. Evaluation was made in the same manner as in Example 16. The magnetic toner particles had an absorbance of 0.72 in the wettability test.

Results obtained are shown in Table 6.

COMPARITIVE EXAMPLE 8

A magnetic toner was prepared in the same manner as in Example 16 except that the kneading conditions were changed to conditions D shown in Table 5. Evaluation was made in the same manner as in Example 16. The magnetic toner particles had an absorbance of 0.18 in the wettability test.

Results obtained are shown in Table 6.

TABLE 1

| | | Kneading conditions | | | | | | | |
|---|---|---|---|---|---|---|---|---|---|
| | | Rotational | Preset*1 temperature | | | | | $\epsilon = F/\pi D^2 L$*2 | $E/\epsilon$ |
| Condition | Kneading machine | speed $\omega$ (m/min) | T (K) | T-273 (° C.) | $k = (D_0/D)^2$ | $E = k\omega^2 T$ ($m^2K/min^2$) | F (kg/min) | (kg/ $m^3 \cdot min$) | [$m^2 \cdot K$/ ($kg/m^3$) · min] |
| A | TEM-100B | 28.2 | 403 | 130 | 1 | $3.20 \times 10^5$ | 11.67 | 123.8 | $2.58 \times 10^3$ |
| B | TEM-100B | 37.7 | 403 | 130 | 1 | $5.73 \times 10^5$ | 11.67 | 123.8 | $4.02 \times 10^3$ |
| C | TEM-100B | 37.7 | 423 | 150 | 1 | $6.01 \times 10^5$ | 11.67 | 123.8 | $4.85 \times 10^3$ |
| D | TEM-100B | 37.7 | 403 | 130 | 1 | $5.73 \times 10^5$ | 8.33 | 88.4 | $6.48 \times 10^3$ |
| E | PCM-87 | 32.7 | 383 | 110 | 1.32 | $5.41 \times 10^5$ | 6.67 | 100.2 | $5.41 \times 10^3$ |
| F | PCM-30 | 18.8 | 403 | 130 | 11.11 | $15.8 \times 10^5$ | 0.33 | 105.1 | $1.50 \times 10^4$ |
| G | TME-100B | 25.1 | 373 | 100 | 1 | $2.35 \times 10^5$ | 11.67 | 123.8 | $1.90 \times 10^3$ |
| H | PCM-87 | 19.1 | 383 | 110 | 1.32 | $1.84 \times 10^5$ | 6.67 | 100.2 | $1.84 \times 10^3$ |
| I | PCM-30 | 16.7 | 403 | 130 | 11.11 | $12.4 \times 10^5$ | 0.17 | 54.2 | $2.29 \times 10^4$ |

*1: The preset temperature refers to an average temperature of at least C3 to C9 when the kneader has the temperature control unit shown in FIG. 1, and the temperature of C3 to C9 are identical in principle but a difference of plus-minus 20° C. from the average temperature is tolerable. In conditions A to I, C3 to C9 are identical.

Figure 2:
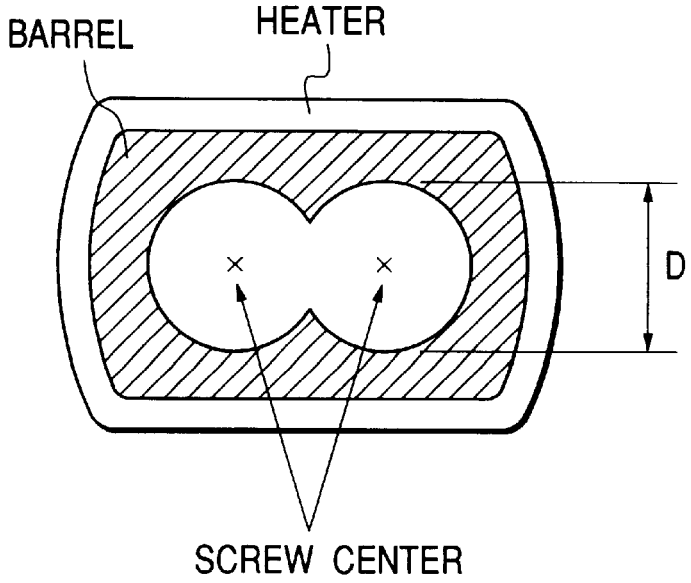
FIG. 2 is a cross-sectional schematic illustration of the constitution of a cylinder.
Figure 3:
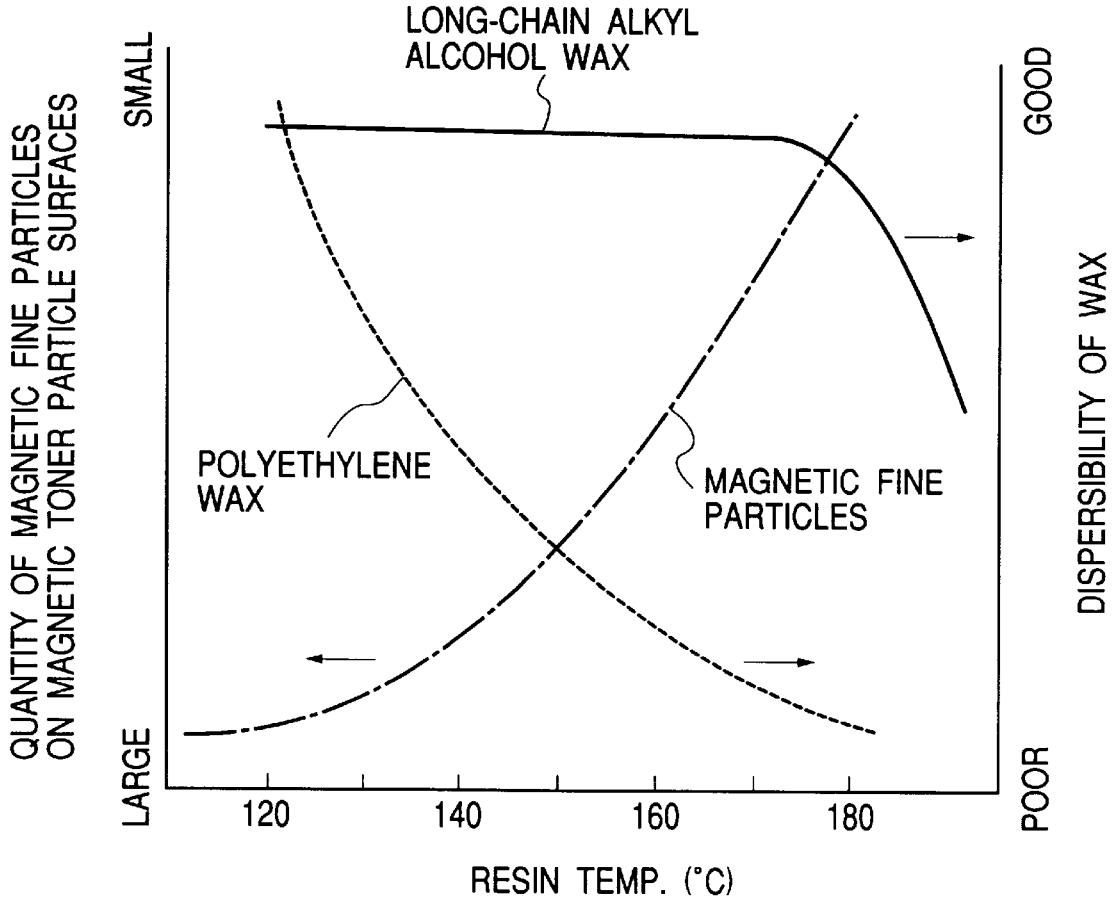
FIG. 3 shows a correlation between the resin temperature, the quantity of free magnetic fine particles and the dispersibility of wax.

*2: As to L and D shown in FIGS. 1 and 2, TME-100B was so set as to be L = 3.00 (m), D = 0.1 (m); PCM-87, L = 2.80 (m), D = 0.087 (m); and PCM-30, L = 1.11 (m), D = 0.03 (m).

TABLE 2

| | Magnetic toner particles | | | | | Magnetic fine powder | | | | | | Wax | |
|---|---|---|---|---|---|---|---|---|---|---|---|---|---|
| | Weight-average paticle diam. (μm) | Absorbance | SF-1 | SF-2 | SF-1/SF-2 | σr | Hc | σr × Hc | $SiO_2$ quantity W (wt. %) | Number-verage particle diam. R (μm) | W × R | Type | Softening point (° C.) |
| Example: | | | | | | | | | | | | | |
| 1 | 5.7 | 0.55 | 154 | 143 | 1.077 | 5.8 | 6.5 | 38 | 0.12 | 0.19 | 0.023 | LCAA | 98 |
| 2 | 5.7 | 0.65 | 156 | 145 | 1.076 | 4.6 | 4.8 | 22 | 0.20 | 0.22 | 0.044 | " | 98 |
| 3 | 5.7 | 0.64 | 155 | 144 | 1.076 | 5.9 | 6.4 | 38 | 0.20 | 0.22 | 0.044 | " | 98 |
| 4 | 5.7 | 0.60 | 154 | 144 | 1.076 | 5.9 | 6.4 | 38 | 0.13 | 0.18 | 0.023 | " | 98 |
| 5 | 5.7 | 0.57 | 154 | 143 | 1.077 | 5.9 | 6.4 | 38 | 0.13 | 0.18 | 0.023 | PE | 130 |
| 6 | 5.7 | 0.55 | 154 | 143 | 1.077 | 5.9 | 6.4 | 38 | 0.13 | 0.18 | 0.023 | LCAA | 98 |
| 7 | 5.7 | 0.50 | 155 | 143 | 1.084 | 5.9 | 6.4 | 38 | 0.13 | 0.18 | 0.023 | " | 98 |
| 8 | 5.7 | 0.50 | 155 | 144 | 1.076 | 5.9 | 6.4 | 38 | 0.13 | 0.18 | 0.023 | " | 98 |
| 9 | 5.7 | 0.58 | 155 | 143 | 1.084 | 5.9 | 6.4 | 38 | 0.13 | 0.18 | 0.023 | " | 98 |
| 10 | 5.7 | 0.52 | 154 | 143 | 1.077 | 5.9 | 6.4 | 38 | 0.13 | 0.18 | 0.023 | " | 98 |
| 11 | 4.0 | 0.68 | 142 | 135 | 1.052 | 5.8 | 6.5 | 38 | 0.12 | 0.19 | 0.023 | " | 98 |
| 12 | 6.5 | 0.30 | 163 | 157 | 1.038 | 5.8 | 6.5 | 38 | 0.12 | 0.19 | 0.023 | " | 98 |
| 13 | 5.7 | 0.55 | 154 | 143 | 1.077 | 7.7 | 7.5 | 58 | 0.04 | 0.14 | 0.006 | " | 98 |
| 14 | 5.7 | 0.60 | 154 | 143 | 1.077 | 7.3 | 7.1 | 52 | 0.08 | 0.1s | 0.012 | " | 98 |
| 15 | 5.7 | 0.54 | 154 | 143 | 1.077 | 5.8 | 6.5 | 38 | 0.12 | 0.19 | 0.023 | PP | 145 |
| Comparative Example: | | | | | | | | | | | | | |
| 1 | 5.7 | 0.72 | 155 | 144 | 1.076 | 4.6 | 4.8 | 22 | 0.20 | 0.22 | 0.044 | LCAA | 98 |
| 2 | 5.7 | 0.77 | 155 | 143 | 1.076 | 4.6 | 4.8 | 22 | 0.20 | 0.22 | 0.044 | " | 98 |
| 3 | 5.7 | 0.18 | 155 | 143 | 1.076 | 4.6 | 4.8 | 22 | 0.20 | 0.22 | 0.044 | " | 98 |
| 4 | 7.5 | 0.15 | 170 | 165 | 1.030 | 4.6 | 4.8 | 22 | 0.20 | 0.22 | 0.044 | " | 98 |
| 5 | 3.0 | 0.80 | 138 | 130 | 1.060 | 4.6 | 4.8 | 22 | 0.20 | 0.22 | 0.044 | " | 98 |
| 6 | 7.0 | 0.17 | 167 | 160 | 1.043 | 4.6 | 4.8 | 22 | 0.20 | 0.22 | 0.044 | PP | 145 |

LCAA: Long-chain alkyl alcohol
PE: Polyethylene
PP: Polypropylene

TABLE 3

| | Kneading conditions | Dispersion of magnetic fine powder F/M | Dispersion of wax F/M | *1) t1 (° C.) | *2) t1-t2 (° C.) |
|---|---|---|---|---|---|
| Example: | | | | | |
| 1 | B | 1.01 | 1.01 | 159 | 61 |
| 2 | A | 1.02 | 1.01 | 156 | 58 |
| 3 | A | 1.02 | 1.01 | 156 | 58 |
| 4 | A | 1.01 | 1.01 | 156 | 58 |
| 5 | A | 1.04 | 1.18 | 154 | 24 |
| 6 | B | 1.01 | 1.01 | 159 | 61 |
| 7 | C | 1.02 | 1.01 | 161 | 63 |
| 8 | D | 1.02 | 1.01 | 161 | 63 |
| 9 | E | 1.01 | 1.01 | 155 | 57 |
| 10 | F | 1.01 | 1.01 | 153 | 55 |
| 11 | A | 1.03 | 1.02 | 156 | 58 |
| 12 | F | 1.02 | 1.02 | 153 | 55 |
| 13 | A | 1.02 | 1.01 | 156 | 58 |
| 14 | A | 1.02 | 1.01 | 156 | 58 |
| 15 | A | 1.03 | 1.15 | 152 | 7 |
| Comparative Example: | | | | | |
| 1 | G | 1.01 | 1.01 | 152 | 54 |
| 2 | H | 1.01 | 1.02 | 153 | 55 |
| 3 | I | 1.03 | 1.10 | 160 | 62 |
| 4 | I | 1.03 | 1.10 | 160 | 62 |
| 5 | G | 1.01 | 1.01 | 152 | 62 |
| 6 | I | 1.04 | 1.30 | 165 | 20 |

*1) t1 (° C.) represents the temperature of the kneaded product immediately after kneading
*2) t2 (° C.) represents the softening point of the wax.

TABLE 4-1

| | Normal temperature/normal humidity environment (23° C., 60% RH) | | | | | | | | | |
|---|---|---|---|---|---|---|---|---|---|---|
| | Solid black image density | | | Fog | | | Charging | | | |
| | Initial stage | 3,000th sheet | 6,000th sheet | Initial stape | Up to 3,000 sheets | Up to 6,000 sheets | roller contamination | Melt-adhesion to drum | 600 dpi dot image | 1,200 dpi dot image |
| Example: | | | | | | | | | | |
| 1 | 1.45 | 1.44 | 1.42 | 0.5 | 0.6 | 0.6 | 5 | 5 | A | A |
| 2 | 1.41 | 1.40 | 1.39 | 1.0 | 1.2 | 1.2 | 5 | 4 | B | C |
| 3 | 1.45 | 1.43 | 1.40 | 0.8 | 1.0 | 1.0 | 5 | 5 | B | C |
| 4 | 1.45 | 1.43 | 1.40 | 0.6 | 1.0 | 1.0 | 5 | 5 | A | B |
| 5 | 1.45 | 1.42 | 1.40 | 0.8 | 0.8 | 0.9 | 5 | 5 | A | B |
| 6 | 1.45 | 1.43 | 1.41 | 0.6 | 0.8 | 0.8 | 5 | 5 | A | B |
| 7 | 1.44 | 1.42 | 1.40 | 0.7 | 0.8 | 0.8 | 5 | 5 | A | B |
| 8 | 1.43 | 1.41 | 1.40 | 0.5 | 0.6 | 0.7 | 5 | 5 | A | B |
| 9 | 1.45 | 1.43 | 1.40 | 0.5 | 0.6 | 0.6 | 5 | 5 | A | B |
| 10 | 1.42 | 1.40 | 1.38 | 0.5 | 0.7 | 0.7 | 5 | 5 | A | B |
| 11 | 1.38 | 1.35 | 1.32 | 2.3 | 2.5 | 2.5 | 4 | 3 | A | A |
| 12 | 1.45 | 1.42 | 1.40 | 0.7 | 0.8 | 0.8 | 5 | 5 | B | C |
| 13 | 1.45 | 1.42 | 1.40 | 0.4 | 0.5 | 0.5 | 5 | 5 | A | B |
| 14 | 1.43 | 1.41 | 1.39 | 0.5 | 0.6 | 0.6 | 5 | 5 | B | C |
| 15 | 1.40 | 1.37 | 1.35 | 1.0 | 1.2 | 1.2 | 5 | 5 | B | C |
| Comparative Example: | | | | | | | | | | |
| 1 | 1.42 | 1.38 | 1.36 | 1.2 | 1.5 | 1.5 | 4 | 3 | B | C |
| 2 | 1.42 | 1.40 | 1.38 | 1.5 | 1.6 | 1.6 | 3 | 2 | B | C |
| 3 | 1.44 | 1.42 | 1.38 | 0.8 | 1.1 | 1.2 | 5 | 5 | B | C |
| 4 | 1.45 | 1.42 | 1.40 | 0.5 | 0.7 | 0.8 | 5 | 5 | C | D |
| 5 | 1.37 | 1.34 | 1.30 | 2.7 | 3.0 | 3.0 | 3 | 2 | A | B |
| 6 | 1.40 | 1.37 | 1.35 | 1.1 | 1.2 | 1.3 | 5 | 5 | C | D |

TABLE 4-2

| | Low temperature/low humidity environment (15° C., 10% RH) | | | | | | | | | |
|---|---|---|---|---|---|---|---|---|---|---|
| | Solid black image density | | | Fog | | | Charging | | | |
| | Initial stage | 3,000th sheet | 6,000th sheet | Initial stape | Up to 3,000 sheets | Up to 6,000 sheets | roller contamination | Melt-adhesion to drum | 600 dpi dot image | 1,200 dpi dot image |
| Example: | | | | | | | | | | |
| 1 | 1.45 | 1.42 | 1.40 | 1.2 | 1.3 | 1.3 | 5 | 5 | A | A |
| 2 | 1.38 | 1.34 | 1.30 | 2.0 | 2.3 | 2.3 | 3 | 4 | B | C |
| 3 | 1.40 | 1.37 | 1.33 | 1.3 | 1.8 | 1.9 | 3 | 4 | B | C |
| 4 | 1.40 | 1.38 | 1.35 | 1.0 | 1.5 | 1.5 | 4 | 5 | A | B |
| 5 | 1.42 | 1.40 | 1.38 | 1.2 | 1.6 | 1.7 | 5 | 5 | A | B |
| 6 | 1.44 | 1.42 | 1.40 | 1.2 | 1.4 | 1.4 | 5 | 5 | A | B |
| 7 | 1.41 | 1.37 | 1.35 | 1.1 | 1.3 | 1.4 | 5 | 5 | A | B |
| 8 | 1.42 | 1.37 | 1.34 | 1.0 | 1.4 | 1.4 | 5 | 5 | A | B |
| 9 | 1.43 | 1.40 | 1.38 | 1.1 | 1.5 | 1.6 | 4 | 5 | A | B |
| 10 | 1.42 | 1.37 | 1.35 | 1.0 | 1.3 | 1.3 | 5 | 5 | A | B |
| 11 | 1.35 | 1.30 | 1.25 | 2.2 | 3.6 | 3.6 | 3 | 4 | A | B |
| 12 | 1.42 | 1.40 | 1.36 | 0.8 | 1.2 | 1.2 | 5 | 5 | B | C |
| 13 | 1.41 | 1.38 | 1.35 | 0.7 | 1.1 | 1.2 | 5 | 5 | A | B |
| 14 | 1.40 | 1.36 | 1.32 | 0.7 | 1.2 | 1.3 | 5 | 5 | A | B |
| 15 | 1.35 | 1.30 | 1.26 | 1.2 | 2.0 | 2.0 | 5 | 5 | B | C |
| Comparative Example: | | | | | | | | | | |
| 1 | 1.43 | 1.38 | 1.35 | 1.2 | 2.7 | 2.7 | 2 | 3 | B | C |
| 2 | 1.39 | 1.36 | 1.32 | 1.4 | 2.8 | 3.0 | 1 | 2 | B | C |
| 3 | 1.32 | 1.28 | 1.26 | 1.0 | 1.4 | 1.5 | 5 | 5 | B | C |
| 4 | 1.38 | 1.35 | 1.32 | 0.8 | 1.0 | 1.0 | 5 | 5 | C | D |
| 5 | 1.30 | 1.25 | 1.20 | 3.0 | 4.2 | 4.2 | 1 | 2 | A | B |
| 6 | 1.36 | 1.33 | 1.30 | 1.2 | 2.5 | 2.5 | 5 | 5 | C | D |

TABLE 4-3

| | High temperature/high humidity environment (32.5° C., 80% RH) | | | | | | | | | | |
|---|---|---|---|---|---|---|---|---|---|---|---|
| | Solid black image density | | | Fog | | | Charging roller contamination | Melt-adhesion to drum | Dot image | | Morning 1st sh. solid black image density |
| | Initial stage | 3,000th sheet | 6,000th sheet | Initial stage | Up to 3,000 sheets | Up to 6,000 sheets | | | 600 dpi | 1,200 dpi | |
| Example: | | | | | | | | | | | |
| 1 | 1.45 | 1.42 | 1.39 | 0.6 | 0.8 | 0.8 | 5 | 5 | A | A | 1.38 |
| 2 | 1.40 | 1.37 | 1.33 | 1.2 | 1.4 | 1.5 | 4 | 3 | C | D | 1.32 |
| 3 | 1.44 | 1.39 | 1.36 | 1.0 | 1.3 | 1.3 | 5 | 4 | C | D | 1.34 |
| 4 | 1.45 | 1.41 | 1.37 | 0.9 | 1.1 | 1.2 | 5 | 4 | B | C | 1.38 |
| 5 | 1.45 | 1.40 | 1.36 | 1.1 | 1.3 | 1.3 | 5 | 5 | B | C | 1.36 |
| 6 | 1.45 | 1.42 | 1.34 | 0.8 | 1.0 | 1.0 | 5 | 5 | B | C | 1.38 |
| 7 | 1.44 | 1.41 | 1.38 | 0.7 | 1.0 | 1.1 | 5 | 5 | B | C | 1.37 |
| 8 | 1.43 | 1.40 | 1.35 | 0.6 | 0.9 | 1.0 | 5 | 5 | B | C | 1.35 |
| 9 | 1.45 | 1.42 | 1.38 | 1.0 | 1.0 | 1.2 | 5 | 4 | B | C | 1.38 |
| 10 | 1.42 | 1.38 | 1.36 | 0.8 | 0.9 | 0.9 | 5 | 5 | B | C | 1.35 |
| 11 | 1.38 | 1.34 | 1.28 | 1.8 | 2.2 | 2.2 | 4 | 3 | A | B | 1.30 |
| 12 | 1.45 | 1.41 | 1.39 | 0.6 | 0.7 | 0.8 | 5 | 5 | C | D | 1.38 |
| 13 | 1.45 | 1.40 | 1.37 | 0.6 | 0.6 | 0.7 | 5 | 5 | B | C | 1.36 |
| 14 | 1.42 | 1.38 | 1.34 | 0.5 | 0.7 | 0.8 | 5 | 5 | B | C | 1.35 |
| 15 | 1.38 | 1.34 | 1.29 | 1.1 | 1.2 | 1.2 | 5 | 5 | C | D | 1.30 |
| Comparative Example: | | | | | | | | | | | |
| 1 | 1.41 | 1.36 | 1.31 | 1.5 | 1.8 | 1.8 | 3 | 2 | C | D | 1.29 |
| 2 | 1.40 | 1.36 | 1.32 | 1.7 | 1.9 | 2.0 | 2 | 1 | C | D | 1.28 |
| 3 | 1.44 | 1.40 | 1.37 | 1.0 | 1.1 | 1.1 | 5 | 5 | C | D | 1.36 |
| 4 | 1.45 | 1.42 | 1.38 | 0.5 | 0.6 | 0.7 | 5 | 5 | D | D | 1.38 |
| 5 | 1.35 | 1.31 | 1.22 | 2.0 | 2.7 | 2.7 | 2 | 1 | A | B | 1.25 |
| 6 | 1.40 | 1.35 | 1.30 | 1.0 | 1.4 | 1.4 | 5 | 5 | D | D | 1.30 |

TABLE 5

| | | Kneading conditions | | | | | | | | |
|---|---|---|---|---|---|---|---|---|---|---|
| | | Rotational | Preset*1 temperature | | | | | $\epsilon = F/\pi D^2 L$*2 | | $E/\epsilon$ |
| Condition | Kneading machine | speed ω (m/min) | T (K) | T-273 (° C.) | $k = (D_0/D)^2$ | $E = k\omega^2 T$ ($m^2K/min^2$) | F (kg/min) | (kg/$m^3$ · min) | | [$m^2$ · K/(kg/$m^3$) · min] |
| A | TEM-100B | 28.2 | 403 | 130 | 1 | $3.20 \times 10^5$ | 11.67 | 123.8 | | $2.58 \times 10^3$ |
| B | TEM-100B | 37.7 | 403 | 130 | 1 | $5.73 \times 10^5$ | 11.67 | 123.8 | | $4.02 \times 10^3$ |
| C | TEM-100B | 25.1 | 373 | 100 | 1 | $2.35 \times 10^5$ | 11.67 | 123.8 | | $1.90 \times 10^3$ |
| D | PCM-30 | 16.7 | 403 | 130 | 11.11 | $12.4 \times 10^5$ | 0.17 | 54.2 | | $2.29 \times 10^4$ |

*1: The preset temperature refers to an average temperature of at least C3 to C9 when the kneader has the temperature control unit shown in FIG. 1, and the temperature of C3 to C9 are identical in principle but a difference of plus-minus 20° C. from the average temperature is tolerable. In conditions A to I, C3 to C9 are identical.
*2: As to L and D shown in FIGS. 1 and 2, TME-100B was so set as to be L = 3.00 (m), D = 0.1 (m); and PCM-30, L = 1.11 (m), D = 0.03 (m).

TABLE 6

| | Form of contact charging roller | | Kneading conditions | Absorbance | Magnetic fine powder | | Image evaluation | | | | |
|---|---|---|---|---|---|---|---|---|---|---|---|
| | | | | | | | L/L | | | H/H | |
| | Rubber layer | Surface layer | | | σr × Hc | W × R | Solid black image density | fog | Charging roller contamination | Morning 1st sh. image density | Melt adhesion to drum |
| Example: | | | | | | | | | | | |
| 10 | EPDM | Nylon resin | A | 0.65 | 22 | 0.044 | 1.32 | 2.5 | 3 | 1.30 | 3 |
| 11 | EPDM | Nylon resin | A | 0.64 | 38 | 0.044 | 1.35 | 2.0 | 3 | 1.32 | 4 |
| 12 | EPDM foam | Nylon resin | A | 0.64 | 38 | 0.024 | 1.35 | 2.0 | 4 | 1.32 | 4 |
| 13 | EPDM foam | Fluorine-cont. acrylic resin | A | 0.64 | 38 | 0.024 | 1.36 | 1.9 | 5 | 1.31 | 4 |
| 14 | EPDM foam | Fluorine-cont. acrylic resin | B | 0.55 | 38 | 0.024 | 1.35 | 1.7 | 5 | 1.35 | 5 |
| Comparative Example: | | | | | | | | | | | |
| 4 | EPDM | Nylon resin | C | 0.73 | 22 | 0.044 | 1.35 | 3.0 | 1 | 1.25 | 1 |
| 5 | EPDM | Nylon resin | D | 0.18 | 22 | 0.044 | 1.25 | 1.5 | 4 | 1.35 | 3 |

L/L: Low temperature/low humidity environment
H/H: High temperature/high humidity environment

What is claimed is:

1. A magnetic toner for developing an electrostatic image, comprising magnetic toner particles containing at least a binder resin, a magnetic fine powder and a wax, wherein;

said magnetic toner particles have a weight-average particle diameter of from 3.5 to 6.5 μm; and a dispersion prepared by dispersing 15 mg of the magnetic toner particles in 19 ml of a mixed solution of ethyl alcohol and water in a volume ratio of 27:73 has an absorbance of from 0.3 to 0.69 at a wavelength of 600 nm.

2. The magnetic toner according to claim 1, wherein said magnetic fine powder has, under application of a magnetic field of 795.8 kA/m (10 K oersted), a residual magnetization (σr ($Am^2$/kg)) and a coercive force (Hc (kA/m)) the product of which (σr×Hc) is from 24 to 56 ($kA^2m$/kg).

3. The magnetic toner according to claim 2, wherein the product (σr×Hc) of the residual magnetization (σr) and the coercive force (Hc) of said magnetic fine powder is from 30 to 52 ($kA^2m$/kg).

4. The magnetic toner according to claim 1, wherein said magnetic fine powder is constituted of magnetic fine particles, has magnetic fine particles having spherical shapes and has at least silicon dioxide on the surfaces of the magnetic fine particles, and the magnetic fine particles fulfill the following condition:

$$0.003 \leqq W \times R \leqq 0.042$$

wherein W represents a weight percentage of the silicon dioxide present on the surfaces of the magnetic fine particles, and R represents a number-average particle diameter (μm) of the magnetic fine powder.

5. The magnetic toner according to claim 4, wherein the magnetic fine particles of said magnetic fine powder fulfill the following conditions:

$$0.008 \leqq W \times R \leqq 0.035.$$

6. The magnetic toner according to claim 1, wherein said wax comprises a long-chain alkyl alcohol.

7. The magnetic toner according to claim 6, wherein said long-chain alkyl alcohol is represented by the structural formula $CH_3(CH_2)_nOH$ where n represents an integer of from 20 to 300.

8. The magnetic toner according to claim 1, wherein said magnetic toner particles has the value of shape factor SF-1 of 140<SF-1≦180 and the value of shape factor SF-2 of 130<SF-2≦170.

9. The magnetic toner according to claim 1, wherein said binder resin is a styrene resin having, in its molecular weight distribution as measured by gel permeation chromatography, peaks at least in the regions of a molecular weight of from $0.5\times10^4$ to $5\times10^4$ and a molecular weight of from $1.0\times10^5$ to $5.0\times10^6$.

10. The magnetic toner according to claim 9, wherein said styrene resin is a resin selected from the group consisting of a styrene polymer, a styrene copolymer, a styrene-acrylate copolymer, a styrene-methacrylate copolymer and a mixture of any of these.

11. The magnetic toner according to claim 9, wherein said styrene resin has a weight-average molecular weight of from 150,000 to 350,000.

12. The magnetic toner according to claim 1, wherein said magnetic fine powder is contained in the magnetic toner particles in an amount of from 40% by weight to 60% by weight based on the weight of the magnetic toner particles.

13. The magnetic toner according to claim 1, wherein said magnetic toner particles have an absorbance of from 0.35 to 0.65.

14. The magnetic toner according to claim 1, wherein said magnetic fine powder has a number-average particle diameter of from 0.05 μm to 0.30 μm.

15. The magnetic toner according to claim 1, wherein said magnetic fine powder has a number-average particle diameter of from 0.10 μm to 0.25 μm.

16. The magnetic toner according to claim 1, wherein said magnetic fine powder is contained in the magnetic toner particles in an amount of from 45% by weight to 55% by weight based on the weight of the magnetic toner particles.

17. The magnetic toner according to claim 1, wherein said magnetic toner particles are mixed with an inorganic fine powder having a BET specific surface area of 30 $m^2$/g or more.

18. The magnetic toner according to claim 17, wherein said inorganic fine powder has a BET specific surface area of from 50 $m^2$/g to 400 $m^2$/g.

19. The magnetic toner according to claim 17, wherein said inorganic fine powder is mixed in an amount of from 0.01 part by weight to 8 parts by weight based on 100 parts by weight of the magnetic toner particles.

20. The magnetic toner according to claim 17, wherein said inorganic fine powder is mixed in an amount of from 0.1 part by weight to 5 parts by weight based on 100 parts by weight of the magnetic toner particles.

21. The magnetic toner according to claim 17, wherein said inorganic fine powder is a fine silica powder treated with a silicone oil.

22. A process cartridge comprising an electrostatic image bearing member, a contact charging means for electrostatically charging the electrostatic image bearing member, and a developing means holding a magnetic toner;

said magnetic toner comprising magnetic toner particles containing at least a binder resin, a magnetic fine powder and a wax, wherein;

said magnetic toner particles have a weight-average particle diameter of from 3.5 to 6.5 $\mu$m; and a dispersion prepared by dispersing 15 mg of the magnetic toner particles in 19 ml of a mixed solution of ethyl alcohol and water in a volume ratio of 27:73 has an absorbance of from 0.3 to 0.69 at wavelength of 600 nm.

23. The process cartridge according to claim 22, wherein said contact charging means is a charging roller.

24. The process cartridge according to claim 22, wherein said electrostatic image bearing member is an OPC photosensitive drum.

25. The process cartridge according to claim 22, wherein said magnetic fine powder has, under application of a magnetic field of 795.8 kA/m (10 K oersted), a residual magnetization ($\sigma r$ ($Am^2/kg$)) and a coercive force (Hc (KA/m)) the product of which ($\sigma r \times Hc$) is from 24 to 56 ($kA^2m/kg$).

26. The process cartridge according to claim 22, wherein said magnetic fine powder is constituted of magnetic fine particles, has magnetic fine particles having spherical shapes and has at least silicon dioxide on the surfaces of the magnetic fine particles, and the magnetic fine particles fulfill the following condition:

$$0.003 \leqq W \times R \leqq 0.042$$

wherein W represents a weight percentage of the silicon dioxide present on the surfaces of the magnetic fine particles, and R represents a number-average particle diameter ($\mu$m) of the magnetic fine powder.

27. The process cartridge according to claim 26, wherein the product ($\sigma r \times Hc$) of the residual magnetization ($\sigma r$) and the coercive force (Hc) of said magnetic fine powder is from 30 to 52 ($kA^2m/kg$).

28. The process cartridge according to claim 26, wherein the magnetic fine particles of said magnetic fine powder fulfill the following conditions:

$$0.008 \leqq W \times R \leqq 0.035.$$

29. The process cartridge according to claim 22, wherein said wax comprises a long-chain alkyl alcohol.

30. The process cartridge according to claim 29, wherein said long-chain alkyl alcohol is represented by the structural formula $CH_3(CH_2)_nOH$ where n represents an integer of from 20 to 300.

31. The process cartridge according to claim 22, wherein said magnetic toner particles has the value of shape factor SF-1 of $140 < SF\text{-}1 \leqq 180$ and the value of shape factor SF-2 of $130 < SF\text{-}2 \leqq 170$.

32. The process cartridge according to claim 22, wherein said binder resin is a styrene resin having, in its molecular weight distribution as measured by gel permeation chromatography, peaks at least in the regions of a molecular weight of from $0.5 \times 10^4$ to $5 \times 10^4$ and a molecular ewight of from $1.0 \times 10^5$ to $5.0 \times 10^6$.

33. The process cartridge according to claim 32, wherein said styrene resin is a resin selected from the group consisting of a styrene polymer, a styrene copolymer, a styrene-acrylate copolymer, a styrene-methacrylate copolymer and a mixture of any of these.

34. The process cartridge according to claim 32, wherein said styrene resin has a weight-average molecular weight of from 150,000 to 350,000.

35. The process cartridge according to claim 22, wherein said magnetic fine powder is contained in the magnetic toner particles in an amount of from 40% by weight to 60% by weight based on the weight of the magnetic toner particles.

36. The process cartridge according to claim 22, wherein said magnetic toner particles have an absorbence of from 0.35 to 0.65.

37. The process cartridge according to claim 22, wherein said magnetic fine powder has a number-average particle diameter of from 0.05 $\mu$m to 0.30 $\mu$m.

38. The process cartridge according to claim 22, wherein said magnetic fine powder has a number-average particle diameter of from 0.10 $\mu$m to 0.25 $\mu$m.

39. The process cartridge according to claim 22, wherein said magnetic fine powder is contained in the magnetic toner particles in an amount of from 45% by weight to 55% by weight based on the weight of the magnetic toner particles.

40. The process cartridge according to claim 22, wherein said magnetic toner particles are mixed with an inorganic fine powder having a BET specific surface area of 30 $m^2/g$ or more.

41. The process cartridge according to claim 40, wherein said inorganic fine powder has a BET specific surface area of from 50 $m^2/g$ to 400 $m^2/g$.

42. The process cartridge according to claim 40, wherein said inorganic fine powder is mixed in an amount of from 0.01 part by weight to 8 parts by weight based on 100 parts by weight of the magnetic toner particles.

43. The process cartridge according to claim 40, wherein said inorganic fine powder is mixed in an amount of from 0.1 parts by weight to 5 parts by weight based on 100 parts by weight of the magnetic toner particles.

44. The process cartridge according to claim 40, wherein said inorganic fine powder is a fine silica powder treated with a silicone oil.

* * * * *

UNITED STATES PATENT AND TRADEMARK OFFICE

CERTIFICATE OF CORRECTION

PATENT NO. : 6,238,834 B1
DATED : May 29, 2001
INVENTOR(S) : Osamu Tamura et al.

It is certified that error appears in the above-identified patent and that said Letters Patent is hereby corrected as shown below:

Column 1,
Line 12, "useing" should read -- using --.

Column 5,
Line 6, "are" should read -- is --; and
Line 34, "shaked" should read -- shaken --.

Column 7,
Line 2, "is" should read -- are --.

Column 11,
Line 25, "$K^{30}$," should read -- $K^{+}$, --.

Column 13,
Line 10, "pound." should read -- pounds --;
Line 62, "such" should read -- such a --; and
Line 63, "relates" should read -- relate --.

Column 16,
Line 45, "block 26" should read -- block 126 --.

Column 17,
Line 16, "block 26" should read -- block 126 --.

Column 21,
Line 66, "a" should read -- an --.

Column 22,
Line 5, "116a" should read -- 116a) --; and
Line 67, "roller" should read -- roller. --.

Column 26,
Line 1, "EXAMPLE" should read -- EXAMPLES --.

Column 30,
Table 2, "0.1s" should read -- 0.15 --.

Column 31,
Table 4-1, "stape" should read -- stage --; and
Table 4-2, "stape" should read -- stage --.

UNITED STATES PATENT AND TRADEMARK OFFICE

CERTIFICATE OF CORRECTION

PATENT NO. : 6,238,834 B1
DATED : May 29, 2001
INVENTOR(S) : Osamu Tamura et al.

It is certified that error appears in the above-identified patent and that said Letters Patent is hereby corrected as shown below:

Column 35,
Line 31, "wherein;" should read -- wherein --.

Column 37,
Line 17, "wherein;" should read -- wherein --; and
Line 23, "at" should read -- at a --.

Column 38,
Line 12, "ewight" should read -- weight --.

Signed and Sealed this

Twenty-sixth Day of March, 2002

*Attest:*

*Attesting Officer*

JAMES E. ROGAN
*Director of the United States Patent and Trademark Office*